US007604224B2

(12) United States Patent
Rowlay et al.

(10) Patent No.: US 7,604,224 B2
(45) **Date of Patent: *Oct. 20, 2009**

(54) MOTORIZED CLAMP

(75) Inventors: Stephen Rowlay, Sheffield (GB); John Alexander, Sheffield (GB)

(73) Assignee: The Stanley Works, New Britain, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/541,578

(22) Filed: Oct. 3, 2006

(65) Prior Publication Data

US 2007/0069438 A1 Mar. 29, 2007

Related U.S. Application Data

(63) Continuation-in-part of application No. 11/394,319, filed on Mar. 31, 2006, now Pat. No. 7,131,642, which is a continuation-in-part of application No. 11/236,566, filed on Sep. 28, 2005, now Pat. No. 7,090,209.

(51) Int. Cl.
*B25B 1/00* (2006.01)

(52) U.S. Cl. ..... 269/6; 269/3

(58) Field of Classification Search ..... 269/6, 269/3, 166–170, 246, 143; 81/487; 29/559
See application file for complete search history.

(56) References Cited

U.S. PATENT DOCUMENTS

| | | | | |
|---|---|---|---|---|
| 1,772,301 | A | 8/1930 | Barker | |
| 4,220,322 | A | 9/1980 | Hobday | |
| 4,524,650 | A | 6/1985 | Marks | |
| 4,664,365 | A | 5/1987 | Heine | |
| 4,736,927 | A | 4/1988 | Clancy | |
| 4,738,438 | A | 4/1988 | Horie et al. | |
| 4,739,838 | A | 4/1988 | Marks | |
| 4,770,401 | A * | 9/1988 | Donaldson | 269/249 |
| 4,850,254 | A | 7/1989 | Burney | |
| 4,926,722 | A | 5/1990 | Sorensen et al. | |
| 5,005,449 | A | 4/1991 | Sorensen et al. | |
| 5,009,134 | A | 4/1991 | Sorensen et al. | |
| 5,022,137 | A | 6/1991 | Sorensen et al. | |
| D320,919 | S | 10/1991 | Sorensen | |
| 5,094,131 | A | 3/1992 | Sorensen et al. | |

(Continued)

FOREIGN PATENT DOCUMENTS

DE 103 58 304 A1 7/2005

(Continued)

OTHER PUBLICATIONS

European Search Report for EP Application No. 07116990.8 for corresponding EP application dated Jan. 22, 2008.

*Primary Examiner*—Lee D Wilson
(74) *Attorney, Agent, or Firm*—Pillsbury Winthrop Shaw Pittman LLP

(57) ABSTRACT

A bar clamp, including a bar; a first jaw movably coupled to the bar; a second jaw being movably coupled to the bar; and a motor configured to move the second jaw toward the first jaw. One of the first and second jaws including a drive lever that engages the bar and a trigger to move the drive lever and move the bar relative to the one of the first and second jaws.

32 Claims, 19 Drawing Sheets

U.S. PATENT DOCUMENTS 5,110,100 A * 5/1992 Cotton ..... 269/244
D328,846 S 8/1992 Sorensen et al.
5,161,787 A 11/1992 Hobday
5,170,682 A 12/1992 Sorensen et al.
5,222,420 A 6/1993 Sorensen et al.
D340,851 S 11/1993 Sorensen
D341,069 S 11/1993 Sorensen
5,265,854 A 11/1993 Whiteford
D357,165 S 4/1995 Sorensen et al.
5,443,246 A 8/1995 Peterson
5,584,458 A 12/1996 Rando
5,593,147 A 1/1997 Read
5,664,817 A 9/1997 Ballew et al.
5,666,964 A 9/1997 Meilus
5,775,680 A 7/1998 Sorensen et al.
5,853,168 A 12/1998 Drake
5,988,616 A 11/1999 Fuller et al.
D417,377 S 12/1999 Blank et al.
6,029,964 A 2/2000 Bohl
6,050,559 A 4/2000 De Souza
6,089,556 A 7/2000 Whiteford
6,254,073 B1 7/2001 Noniewicz et al.
6,302,386 B1 10/2001 Fuller et al.
6,338,475 B1 1/2002 Ping
6,340,154 B1 1/2002 Young
6,347,791 B1 2/2002 Chervenak
6,367,787 B1 4/2002 Poole et al.
6,382,608 B1 * 5/2002 Michell ..... 269/6
6,386,530 B1 5/2002 Marks
6,412,767 B1 7/2002 Beckmann et al.
6,438,854 B1 8/2002 Kott, Jr.
6,450,489 B1 9/2002 Wang
6,474,632 B1 * 11/2002 Liou ..... 269/6
6,568,667 B1 5/2003 Hall
6,578,837 B1 6/2003 Blank et al.
6,585,243 B1 7/2003 Li
6,641,122 B2 11/2003 Roesch
6,648,314 B1 11/2003 Degen et al.
6,648,315 B1 11/2003 Lee
6,655,670 B1 12/2003 Liou
6,676,120 B1 1/2004 Hallbeck et al.
6,685,176 B2 2/2004 Wirth, Jr. et al.
D488,043 S 4/2004 Ben-Gigi
6,758,098 B1 7/2004 Nunnelee
D494,828 S 8/2004 Phillips
D500,238 S 12/2004 Varzino
6,860,179 B2 3/2005 Hopper et al.
6,883,795 B2 4/2005 McCormick et al.
6,957,808 B2 * 10/2005 Varzino et al. ..... 269/95
6,971,641 B1 12/2005 Sherwin
7,066,457 B2 * 6/2006 Gerritsen et al. ..... 269/6
7,090,209 B1 8/2006 Rowlay
7,131,642 B1 11/2006 Rowlay
2003/0075850 A1 4/2003 Wirth, Jr. et al.
2003/0090048 A1 5/2003 Varzino et al.
2003/0141644 A1 7/2003 Thomas
2004/0113344 A1 6/2004 Wirth, Jr. et al.
2004/0140602 A1 7/2004 Gerritsen et al.
2004/0195746 A1 10/2004 Marks
2005/0012184 A1 1/2005 Lo ..... 269/6
2005/0082728 A1 * 4/2005 Cicenas et al. ..... 269/6
2005/0121842 A1 6/2005 Lo
2006/0091596 A1 5/2006 Marusiak
2007/0069438 A1 3/2007 Rowlay et al.
2007/0176342 A1 8/2007 Noniewicz
2008/0053262 A1 3/2008 Geier

FOREIGN PATENT DOCUMENTS

GB 605076 7/1948
GB 2375984 12/2002
WO 95 13165 A 5/1995
WO WO 02/14020 2/2002
WO WO 2005/011918 A2 2/2005
WO 2005087438 9/2005

* cited by examiner

MOTORIZED CLAMP

The subject application is a continuation-in-part application of U.S. patent application Ser. No. 11/394,319, filed on Mar. 31, 2006, which is a continuation-in-part of U.S. patent application Ser. No. 11/236,566, filed on Sep. 28, 2005, now U.S. Pat. No. 7,090,209. Each of these applications is hereby incorporated herein in its entirety by reference thereto, respectively.

FIELD OF THE INVENTION

The present invention relates to a clamp that is adjustable and to a method of using a clamp that is adjustable. More specifically, the present application illustrates embodiments of the present invention, including those relating to a motorized clamp.

BACKGROUND

Known adjustable clamps include one moving jaw and one fixed jaw. U.S. Pat. No. 6,386,530 to Marks, U.S. Pat. No. 6,474,632 to Liou, U.S. Pat. No. 5,005,449 to Sorensen, U.S. Pat. No. 5,443,246 to Peterson, U.S. Pat. No. 5,265,854 to Whiteford, U.S. Pat. No. 5,853,168 to Drake, U.S. Pat. No. 5,664,817 to Ballew et al.; U.S. Pat. No. 6,971,641 to Sherwin; and U.S. Pat. No. 5,666,964 to Meilus, and U.S. Patent Application Publication Nos. 2003/0090048 to Verzino et al.; and 2004/0140602 to Gerritsen et al., which disclose various devices that clamp, are each incorporated herein in its entirety by reference thereto, respectively.

SUMMARY OF THE INVENTION

One aspect of the invention relates to a bar clamp, comprising a bar; a first jaw movably coupled to the bar; a second jaw being movably coupled to the bar; and a motor configured to move the second jaw toward the first jaw, one of the first and second jaws including a drive lever that engages the bar and a trigger to move the drive lever and move the bar relative to the one of the first and second jaws.

Another aspect of the invention includes a bar clamp, comprising a bar; a first jaw movably coupled to the bar; a second jaw coupled to the bar; and a motor attached to the first jaw and attached to the bar and configured to move the bar toward the first jaw, one of the first and second jaws including a drive lever that engages the bar and a trigger to move the drive lever and move the bar relative to the one of the first and second jaws.

Another aspect of the invention includes a bar clamp, comprising a first jaw; a bar being movably coupled to the first jaw; a second jaw being coupled to the bar; and a motor coupled to the first jaw and having a rotatable element, the motor moving the bar relative to the first jaw, the first jaw including a drive lever coupled to the bar and a trigger to move the drive lever and to move the bar relative to the first jaw.

Another aspect of the invention includes a method of using a bar clamp, comprising positioning a first jaw and a second jaw on opposite sides of an item to be clamped, the first and second jaws being positioned on a bar; activating a rotating element of a motor to move the second jaw closer to the first jaw until the first and second jaws contact opposite sides of the item to be clamped; and activating a trigger to provide increased clamping of the first and second jaws against the sides of the item to be clamped.

Other aspects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DESCRIPTION OF ILLUSTRATED EMBODIMENTS

Figure 1:
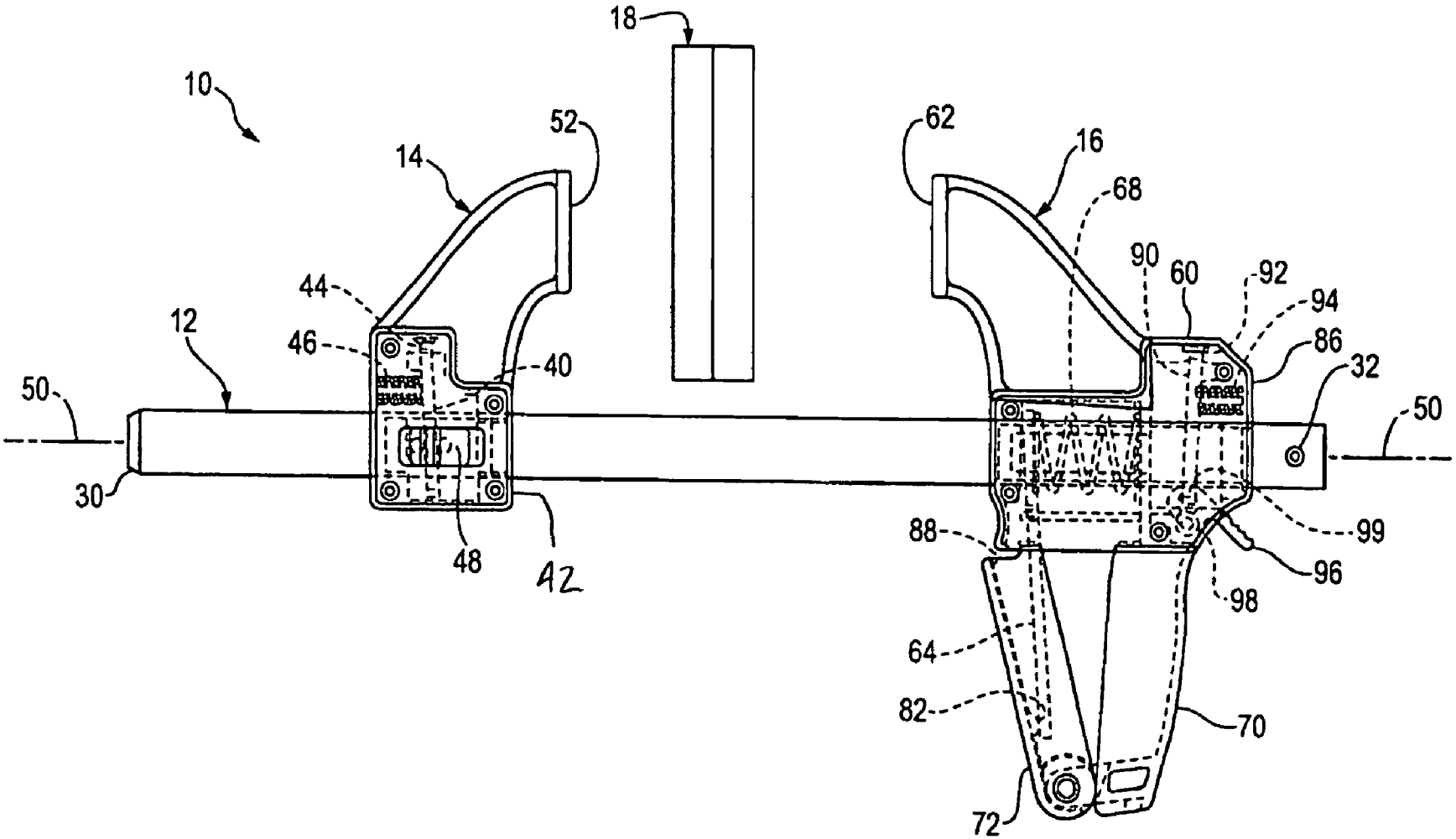
FIG. 1 illustrates a side view of an adjustable clamp, in accordance with one illustrated embodiment of the present invention.

One embodiment of the invention is illustrated in FIGS. 1-5, which illustrate an adjustable clamp 10 having a bar 12, a moving jaw 14, and a fixed jaw 16. In one embodiment, clamp 10 may be used by positioning jaws 14 and 16 on opposite sides of a member 18 to be clamped. The fixed jaw 16 is then activated to pull the bar 12 through the fixed jaw 16, thus bringing moving jaw 14 closer to fixed jaw 16. The fixed jaw 16 may be selectively activated so that the fixed jaw may move the bar 12 rapidly and easily through the fixed jaw 16 prior to the clamping of the member 18 and then, once the clamping on member 18 begins, the activation of fixed jaw 16 may advance the bar 12 through the fixed jaw 16 at a slower rate but with a higher mechanical advantage so that greater force can be applied in the easiest manner for the user applying the pressure to the fixed jaw 16 by hand.

Bar 12 is preferably a solid bar formed of sufficiently rigid material, such as metal or plastic. The bar 12 may have an inserting end 30 and a stop 32 to permit the jaws 14 and 16 to be inserted on the bar and removed from the same end, that is, via the inserting end 30. Alternatively, as discussed with other embodiments, the bar 12 may be formed without a stop 32 and the jaws 14 and 16 may be placed on and taken off the bar 12 at either end.

Although the moving jaw 14 may be any of the various moving-type jaws known in the prior art, moving jaw 14 is illustrated as having a braking lever 40 that permits the bar 12 to pass through moving jaw housing 42. The braking lever 40 is pivoted within the moving jaw housing 42 within a groove 44 and is biased by a resilient element, such as a spring 46. The spring 46 biases the braking lever 40 against the bar 12 to lock the housing 42 and the moving jaw 14 in a selected position on the bar 12. The figures illustrate the spring 46 as being sufficiently compressed to maintain a force against the braking lever 40 towards the locked position. When it is desired to move the moving jaw 14 along the bar 12, a slide release button 48 is slid along a track to move the braking lever 40 from an inclined orientation with respect to the longitudinal axis 50 of the bar 12 to a more perpendicular orientation with respect to the longitudinal axis 50 of bar 12, thus freeing the braking lever 40 from the bar 12 and permitting the moving jaw 14 to move along the bar 12. Preferably, the moving jaw 14 would be moved to a selected position on the bar 12 and then clamped against member 18 upon activation of the fixed jaw 16. The moving jaw has a clamping face 52 for engaging member 18.

Member 18 is any member or members needed clamping. For example, member 18 may be two elements that are being joined together by adhesive and require a clamping force to ensure a tight connection while the adhesive cures.

Fixed jaw 16, as illustrated in the figures, has a main section that is structured and arranged to permit the bar 12 to pass there-through. As illustrated, the main section comprises a housing 60 having an opening extending completely therethrough for the passage of bar 12. The fixed jaw 16 also has a clamping face 62 extending from the housing 60. A drive lever 64 is positioned within the housing 60 and is structured and arranged to couple the bar 12. That is, the illustrated drive lever 64 has an opening 66 extending therethrough for the passage of bar 12. The drive lever 64 is movable within the housing 60 and may be maintained within its area of movement within the housing 60 by the housing 60 itself. Drive lever 64 is biased by a resilient element, such as a spring 68 in a direction away from handle 70, which extends from housing 60 for grasping by a user. In FIGS. 1, 2, 6, 7 and 9-11, spring 68 is compressed sufficiently to apply a force against the respective drive lever 64 (and 264 with respect to FIG. 11) to bias the drive lever 64 to the left as shown in the figures and away from the rear 86 of the housing 42. The handle has a lug 71 to which a trigger 72 is pivoted to the handle 70. The trigger 72 may pivot about a pin 74 extending through lug 71. The trigger 72 pivots at a position on the handle 70 that is the furthestmost position on the handle 70 from the bar 12. As illustrated in the figures, trigger 72 is pivoted to the bottom-most section of the handle 70. The upper section 76 of the trigger 72 is free to move within the housing 60 and is maintained by the outer limits of housing 60 from pivoting outside the housing 60.

The trigger 72 is hollow with three sides and trigger 72 is open in the side facing handle 70. The inner contact surface 80 is the interior side of the trigger 72 that is most remote from the handle 70 and adjacent to the drive lever 64. The inner contact surface 80 provides the points of contact of the trigger 72 with the drive lever 64. As evident herein, as the trigger 72 is pulled toward the handle 70 the contact point with the drive lever changes position.

Figure 2:
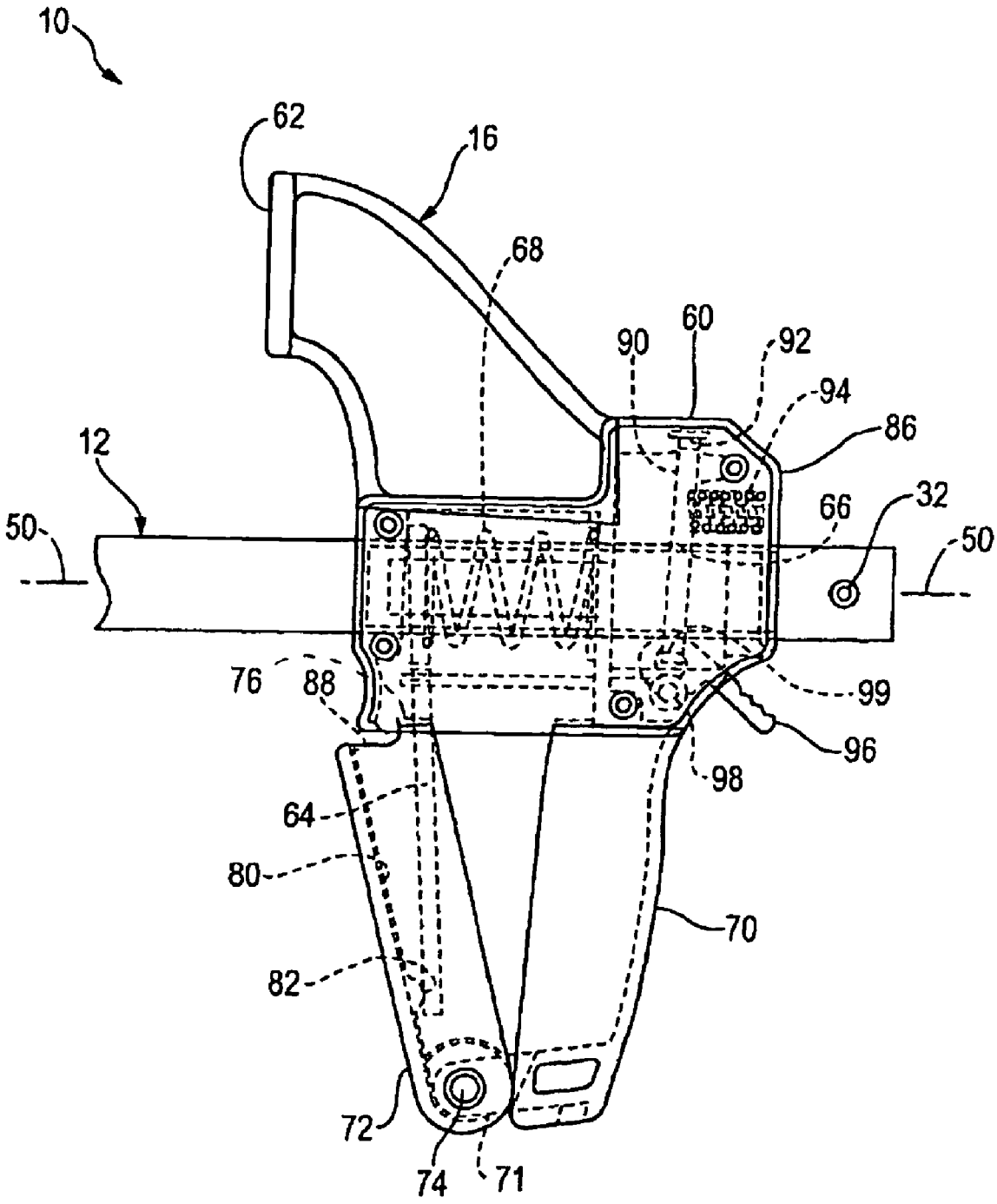
FIG. 2 illustrates an enlarged, side view of the fixed jaw of the clamp of FIG. 1.
Figure 3:
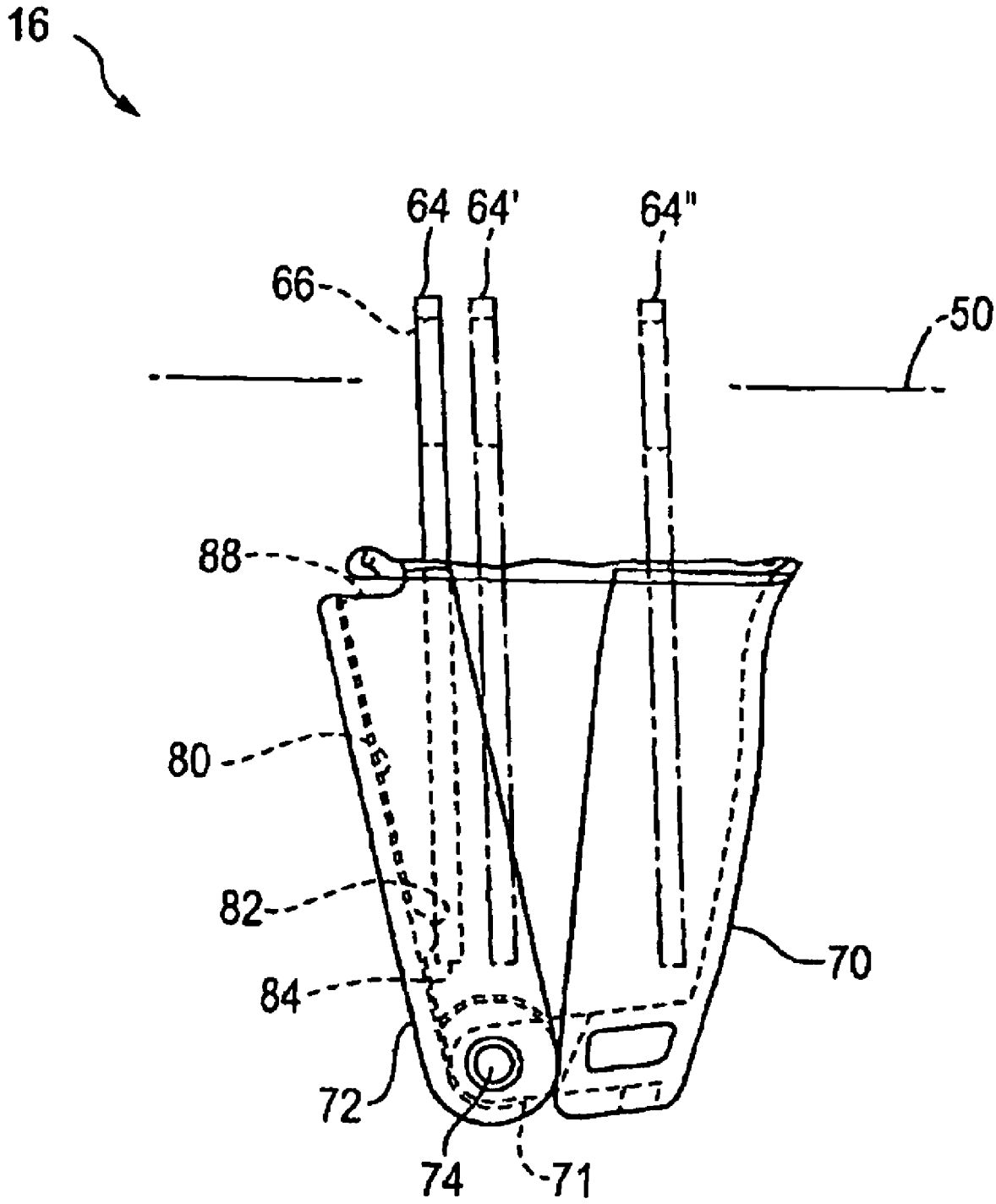
FIGS. 3-5 illustrate partial, views of the fixed jaw illustrated in FIG. 2 but showing the trigger and the drive lever in different positions with respect to the handle during activation of the trigger.

The trigger is shown in the nonactuated position in FIGS. 1-3. When the trigger 72 is in the nonactuated position, the trigger 72 is biased to pivot away from the handle 70 by the force of the drive lever 64 via the biasing of spring 68. In this nonactuated position, the trigger 72 has an initial contact point 82 on the contact surface 80 that is in contact with the drive lever 64. The initial contact point 82 may be in the form of a projection 82, as illustrated.

Figure 4:
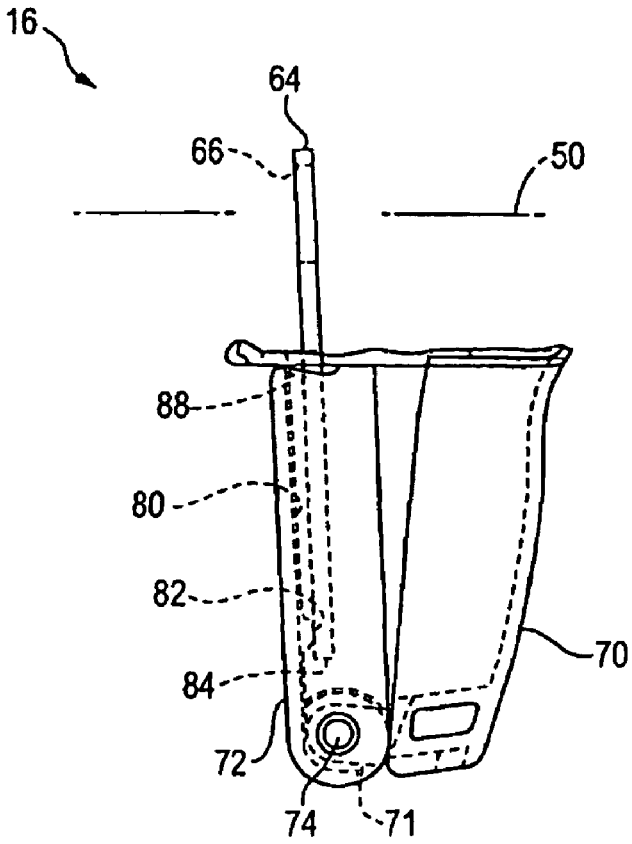
Figure 5:
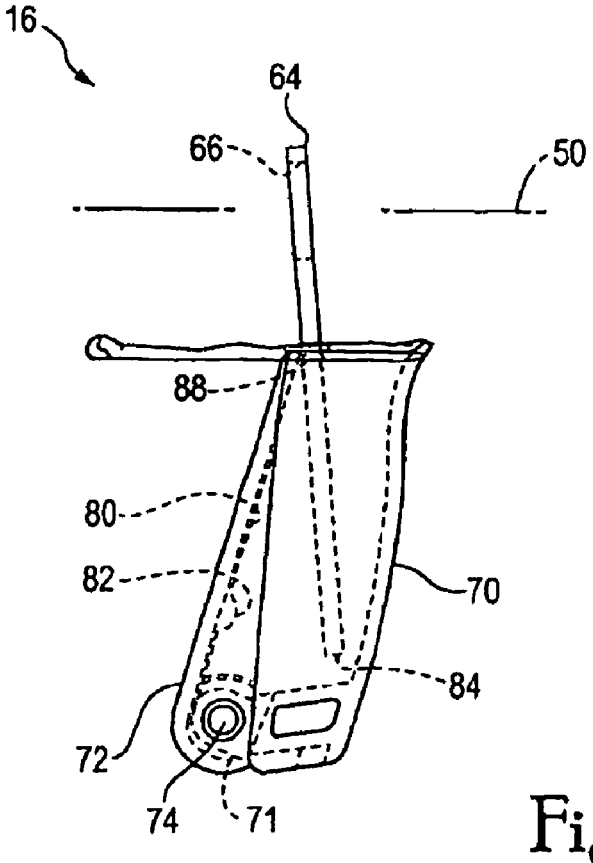

FIGS. 2-5 illustrate the pivoting of trigger 72 and the changing of the contact point between the trigger 72 and the drive lever 64. In FIGS. 2 and 3, the trigger 72 is in the nonactuated position as biased by spring 68. The trigger 72 contacts the driving lever 64 at initial contact point 82, which is at the remote end 84 of drive lever 64, which is the furthest extent of the drive lever 64 from the bar 12. As seen in the figures, the contact point 82 is at the bottom of the drive lever 64. Therefore, when the trigger 72 initially is pulled by a hand of the user and pivots about pin 74 toward the handle 70 out of the nonactuated position, the contact point 84 with the drive lever 64 is such that a high mechanical advantage is produced for forcing the drive lever 64 to move the bar 12 toward the rear end 86 of housing 60. This is because the force applied by the user on the trigger 72 is directed against the drive lever 64 at the furthest point on the drive lever 64 from the connection between the drive lever 64 and bar 12. Since the size of the opening 66 in drive lever 64 is slightly larger than the width of the bar 12, when the angle of drive lever 64 is inclined with respect to a line parallel to the longitudinal axis 50 of the bar 12, as shown in FIGS. 3-5, a tight, slip-free fit is created between the bar 12 and the drive lever 64 so that when the drive lever 64 is moved, the bar 12 moves along with the drive lever 64.

As seen in FIG. 4, as the trigger 72 is pivoted toward handle 70, the contact point 84 between the trigger 72 and the drive lever 64 does not necessarily change, but the pivoting of the trigger 72 moves the protrusion that forms the contact point 84 closer toward the handle 70 and, thus, forces movement to the drive lever 64 toward the rear 86 of housing 60 while continuing to provide a high mechanical advantage since the contact point between the trigger 72 and the drive lever 64 remains at the remote end 84 of the drive lever 64. FIG. 3 shows the positional movement change of the drive lever 64 from the nonactuated position of FIG. 2 (shown with drive lever 64 in solid lines) to the position of FIG. 4 (shown with the drive lever 64' (primed) in dashed lines).

As the trigger 72 is pulled further, as seen in FIG. 5, the trigger 72 pivots further about pin 74 and the contact point between the trigger 72 and the drive lever 64 shifts from the initial contact point 82 to the final contact point 88, which is substantially closer to the bar 12. Thus, the mechanical advantage is reduced to a low mechanical advantage. This is because the force applied by the user to the trigger 72 is now being applied at contact point 88, which is very close to the bar 12. However, since the trigger 72 is pivoted at the end of handle 70 that is remote from the bar 12, the final contact point 88 moves a great distance compared to the movement of the initial contact point 82. Therefore, although the mechanical advantage shown in FIG. 5 using final contact point 88 is low, the amount that the bar 12 travels to toward the rear 86 of the housing 60 increases. FIG. 3 shows the positional movement change of the drive lever 64 from the position of FIG. 4

(shown with drive lever 64' (prime) in dashed lines) to the position of FIG. 5 (shown with the drive lever 64" (double prime) in dashed lines).

Therefore, if, for example, the fixed jaw 16 is not in contact with the member 18 a user can quickly and easily pull the trigger 72 to its fullest extent and rapidly repeat the full trigger pulls to quickly and easily move the bar 12 toward the rear 86 of housing 60 since the final contact point 88 is employed. Then, when, for example, the jaws 14 and 16 are in contact with the member 18 and it is desired to clamp the member 16 with a large force requiring little movement of the bar 12, the initial contact point 82 will be employed since only slight movement of the bar 12 by the drive lever 64 will be possible and a high mechanical advantage will be produced making it relatively easier for the use to apply a higher clamping force against the bar 12 and the member 18.

Although, the illustrated embodiment only shows two contact points 82 and 88, the contact surface 80 of trigger 72 may be designed so that there is any number of contact points. For example, the contact surface 80 could provide an entirely gradual change of position for the contact point between the trigger 72 and the drive lever 64. Thus, the contact point could gradually move up the drive lever 64 as the trigger 72 is pulled toward the housing 60.

When it is desired to release the clamping force and the bar 12, fixed jaw 16 also has a breaking lever 90 that permits the bar 12 to pass therethrough. The braking lever 90 is pivoted within the housing 60 within a groove 92 and is biased by a resilient element, such as a spring 94. The spring 94 biases the braking lever 90 against the bar 12 to lock the housing 60 and the fixed jaw 16 in a selected position on the bar 12. So that when the trigger 72 is pulled and the bar 12 moves toward the rear 86 of housing 60, the breaking lever 90 is biased by spring 94 to permit movement in that direction but to prohibit movement in the opposite direction. Throughout the figures, spring 94 (as well as braking springs 294 and 494) is illustrated as being sufficiently compressed to apply a constant biasing force against its respective braking lever 90 (as well as braking levers 290 and 490 springs) toward the braking or locking position. The principles of locking are similar to those of the breaking lever 40 of the moving jaw 14 and of the drive lever 64 of the fixed jaw 16. When it is desired to move the bar 12 through the fixed jaw 16 toward the clamping face 62, a release button 96 is used to move the bottom of breaking lever 90 toward the rear 86 of housing 60 and release the bar 12 to move in the forward direction. The release button 96 is pivoted to the housing at pivot 98 and has a mid-portion 99 that captures the bottom of breaking lever 90 to move the lever 90 when the release button 96 is pivoted.

Figure 6:
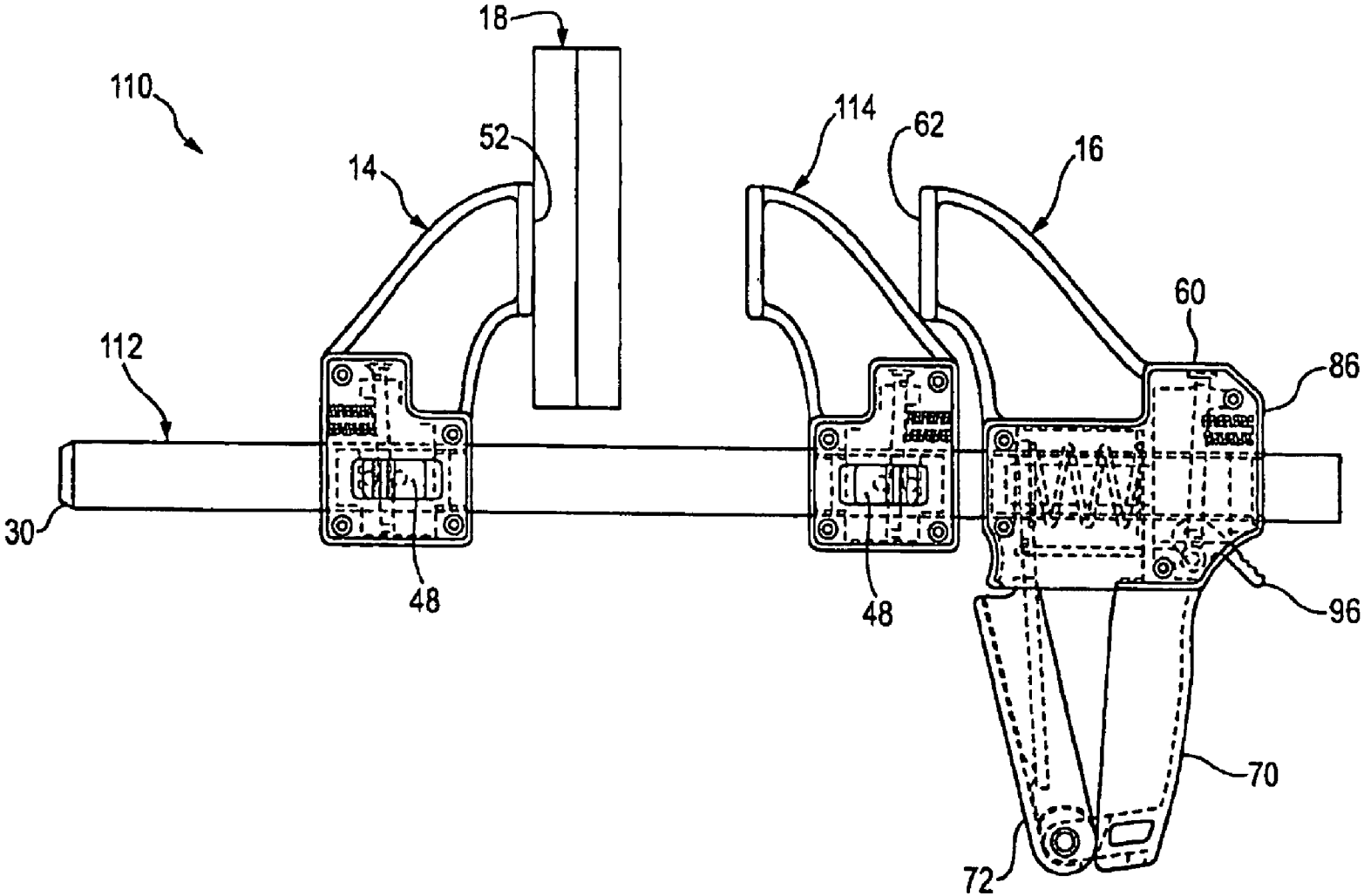
FIG. 6 illustrates an adjustable clamp in accordance with another illustrated embodiment of the present invention.
Figure 7:
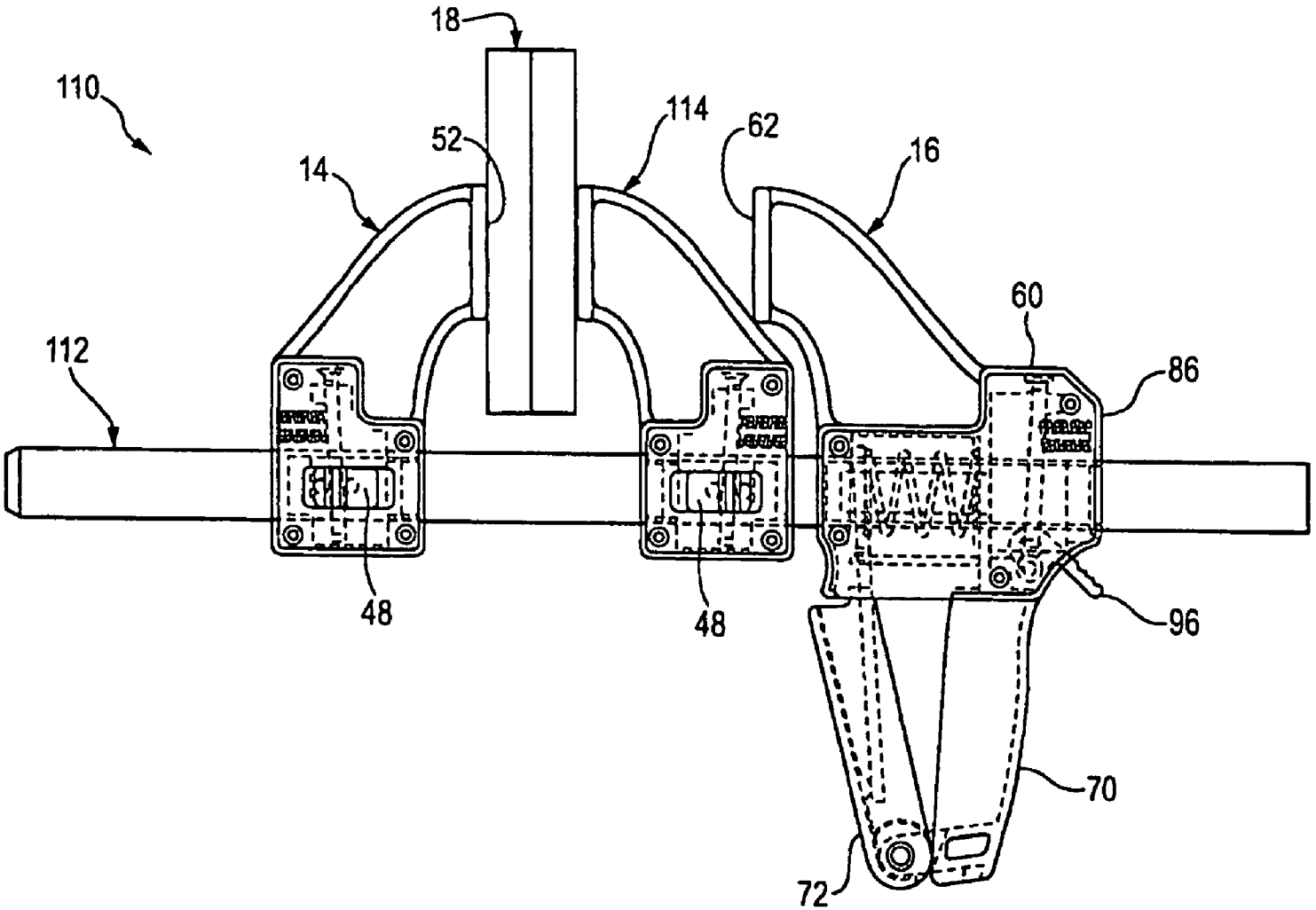
FIG. 7 illustrates the clamp of FIG. 6 clamping the member to be clamped.
Figure 8:
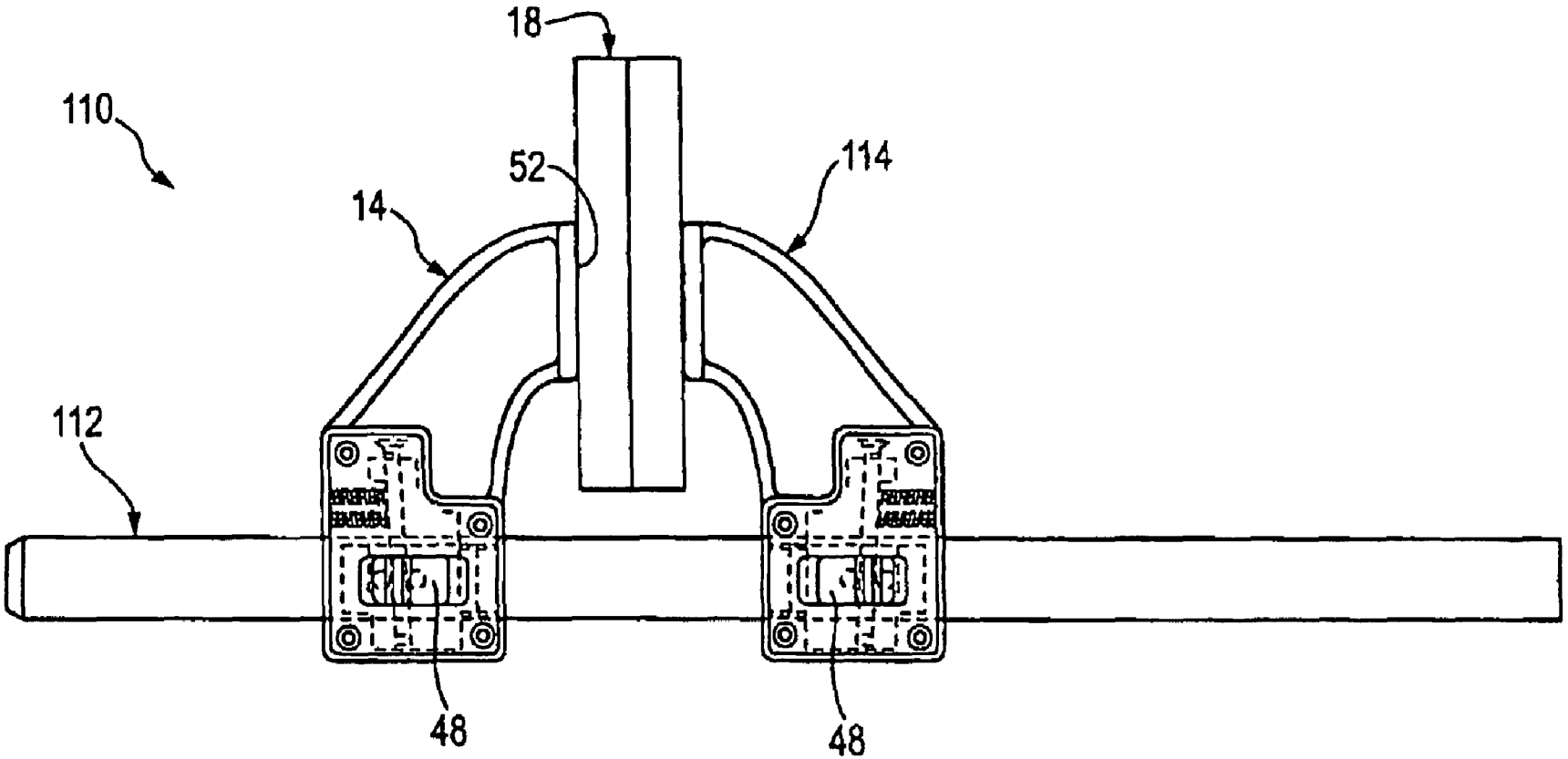
FIG. 8 illustrates the clamp of FIG. 8 with the motor unit removed after the member is clamped.

FIGS. 6-8 show another embodiment of the invention, wherein two moving jaws 14 and 114 are used to clamp member 18. FIG. 6 shows an adjustable clamp 110 having a bar 112, a first moving jaw 14, a second moving jaw 114, and a fixed jaw 16. Clamp 110 is substantially identical to clamp 10 described above, except for the inclusion of a second moving jaw 114. Also, moving jaw 114 is substantially identical to moving jaw 14, except that moving jaw 114 is oriented in an opposite direction and, thus, may move freely toward moving jaw 14, but it will only move away from moving jaw 14 if the release button 48 is used. Bar 112 is substantially identical to bar 12 except that bar 112 does not have a stop 32.

As can be seen in FIG. 6, the moving jaw 114 is positioned between the fixed jaw 16 and the moving jaw 14 so that when the fixed jaw 16 is actuated to pull the bar 112 through fixed jaw 16 toward the rear 86 of housing 60, the moving jaw 14 will clamp the member 18 along with second moving jaw 114 instead of fixed jaw 16 as seen in FIG. 7. Then, once the first and second moving jaws 14 and 114 clamp member 18, the fixed jaw 16 can be removed from the bar 112 while the clamp on member 18 is maintained and be used in other adjustable clamps, such as in clamps similar to clamp 10 or in clamps similar to clamp 110. Fixed jaw 16 can be removed from bar 12 by pushing the release button 96 and pulling the fixed jaw 16 away from the moving jaw 114 and off the bar 12. When it is desired to release the clamping of member 18, the release buttons 48 are activated.

Figure 9:
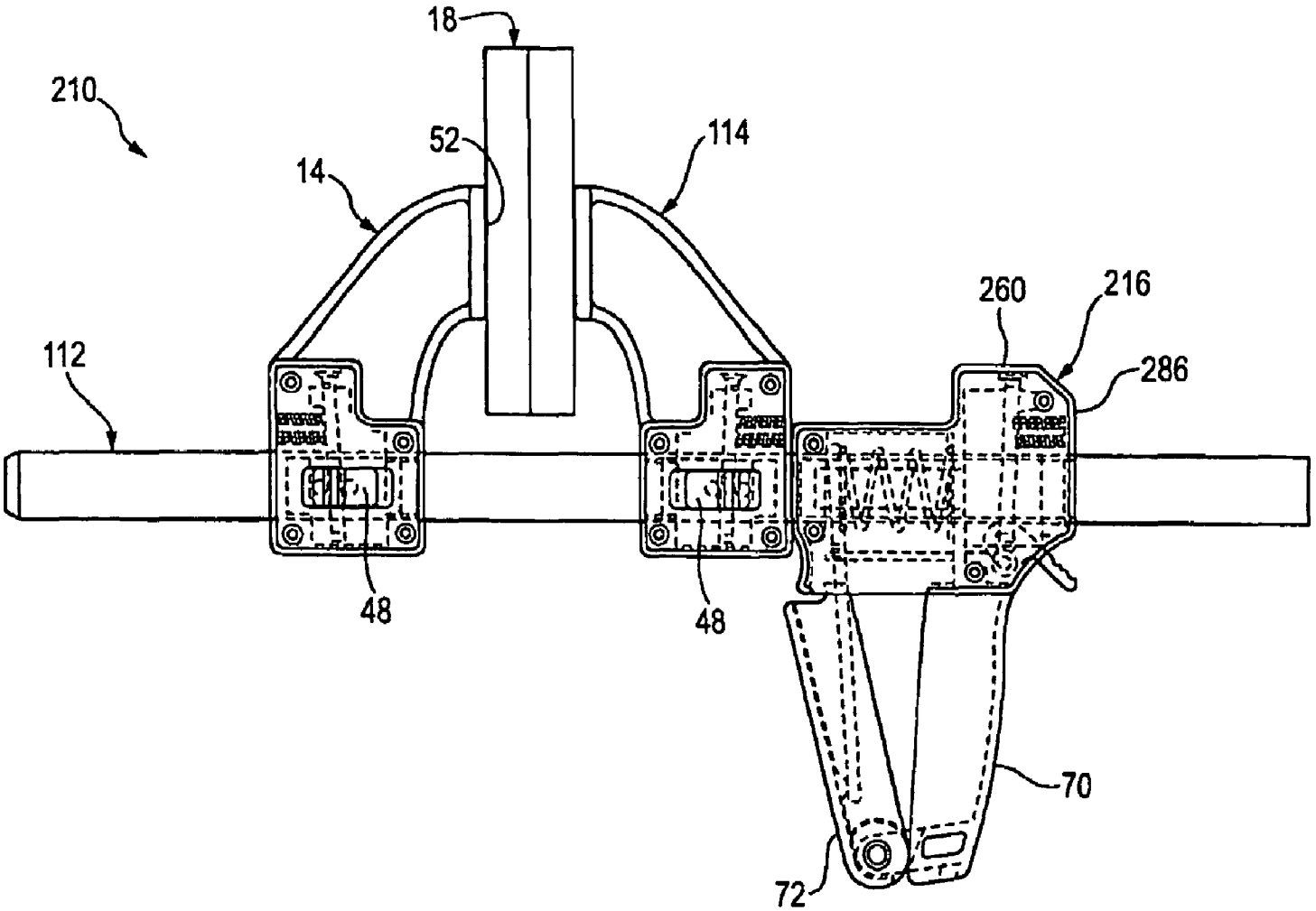
FIG. 9 illustrates an adjustable clamp similar to that shown in FIG. 7, but with motor unit without a clamping surface, in accordance with yet another embodiment of the invention.
Figure 10:
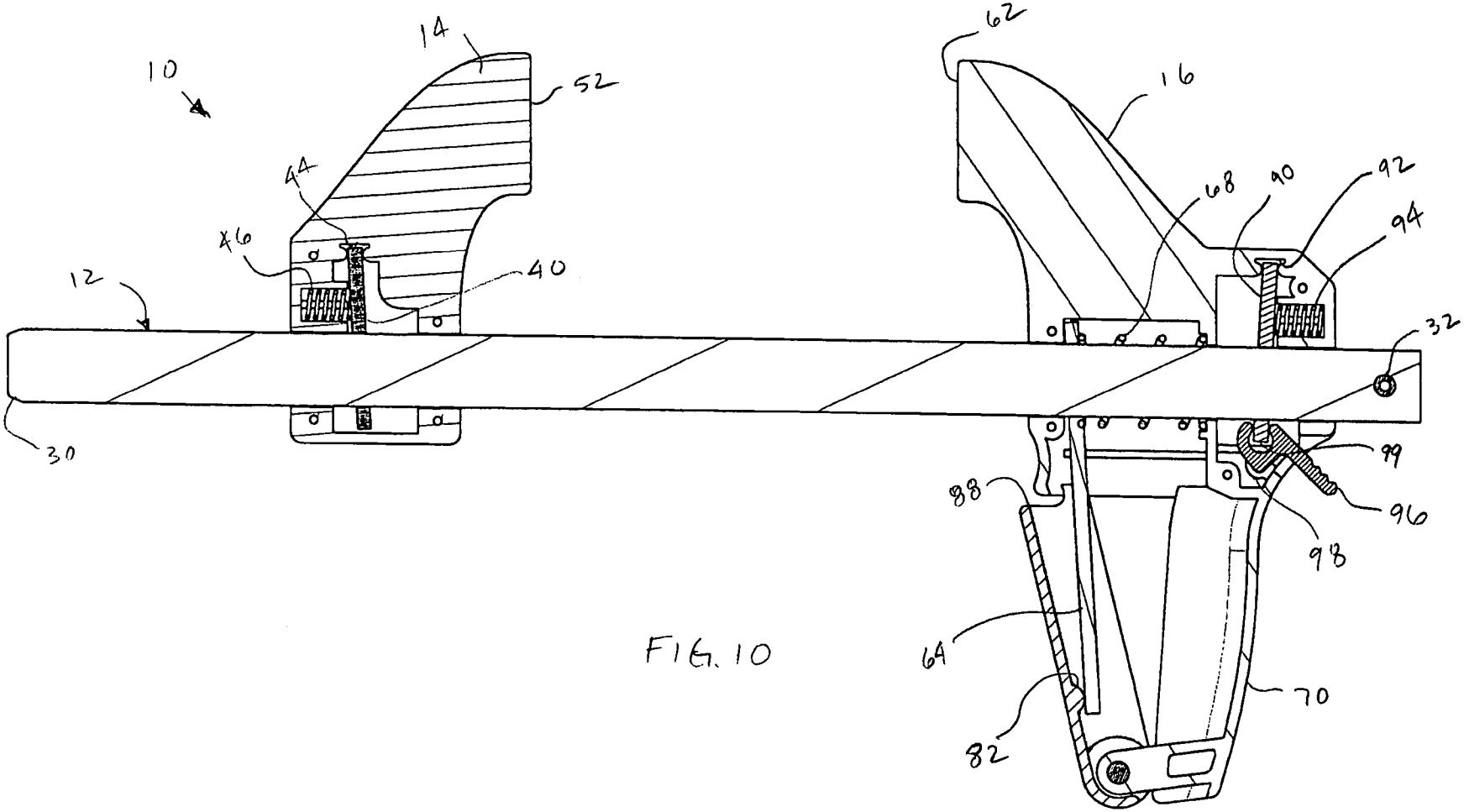
FIG. 10 is a longitudinal, side elevational cross-sectional view of the adjustable clamp of FIG. 1.

FIG. 9 shows yet another embodiment of the invention. FIG. 9 shows an adjustable clamp 210 that is substantially identical to clamp 110 disclosed above in FIGS. 6-8 except that clamp 210 does not use fixed jaw 16. Instead, clamp 210 uses a mechanical motor unit 216 that does not have a clamping surface. That is, mechanical motor unit 216 is substantially identical to fixed jaw 16 except that mechanical motor unit 216 does not have the clamping surface 62 that projects from the housing 60 of fixed jaw 16. Instead, the housing 260 has no projections. The mechanical motor unit 216 may be employed as a force applying mechanism for moving jaws such as 14 and 114 and can be use to clamp numerous devices that are being clamped with, for example, two moving jaws as seen in FIG. 8.

Additionally, the ability to remove the fixed jaw 16 or the motor unit 216 in addition to the moving jaws 14 and 114 permit different length bars to be employed with the same clamping devices, such as, 14, 114, and 16. Thus, a user can have one set of clamping devices (jaws/motor units), such as 14 and 16 or 14, 114, and 16, and bars of different lengths for different applications. This concept of using different length bars is equally applicable in all of the embodiments disclosed herein.

Figure 11:
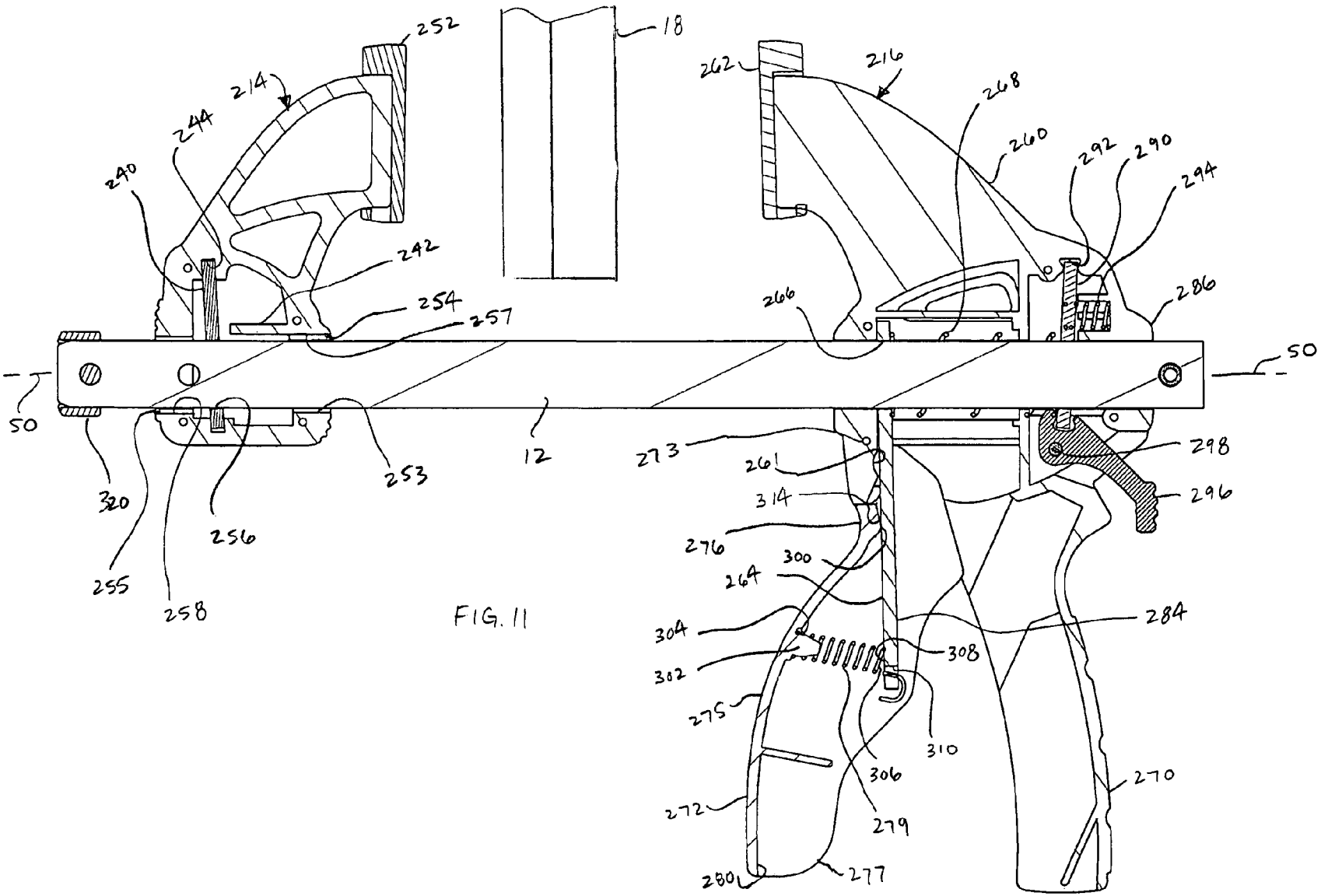
FIG. 11 illustrates an adjustable clamp in accordance with yet another embodiment of the invention.
Figure 12:
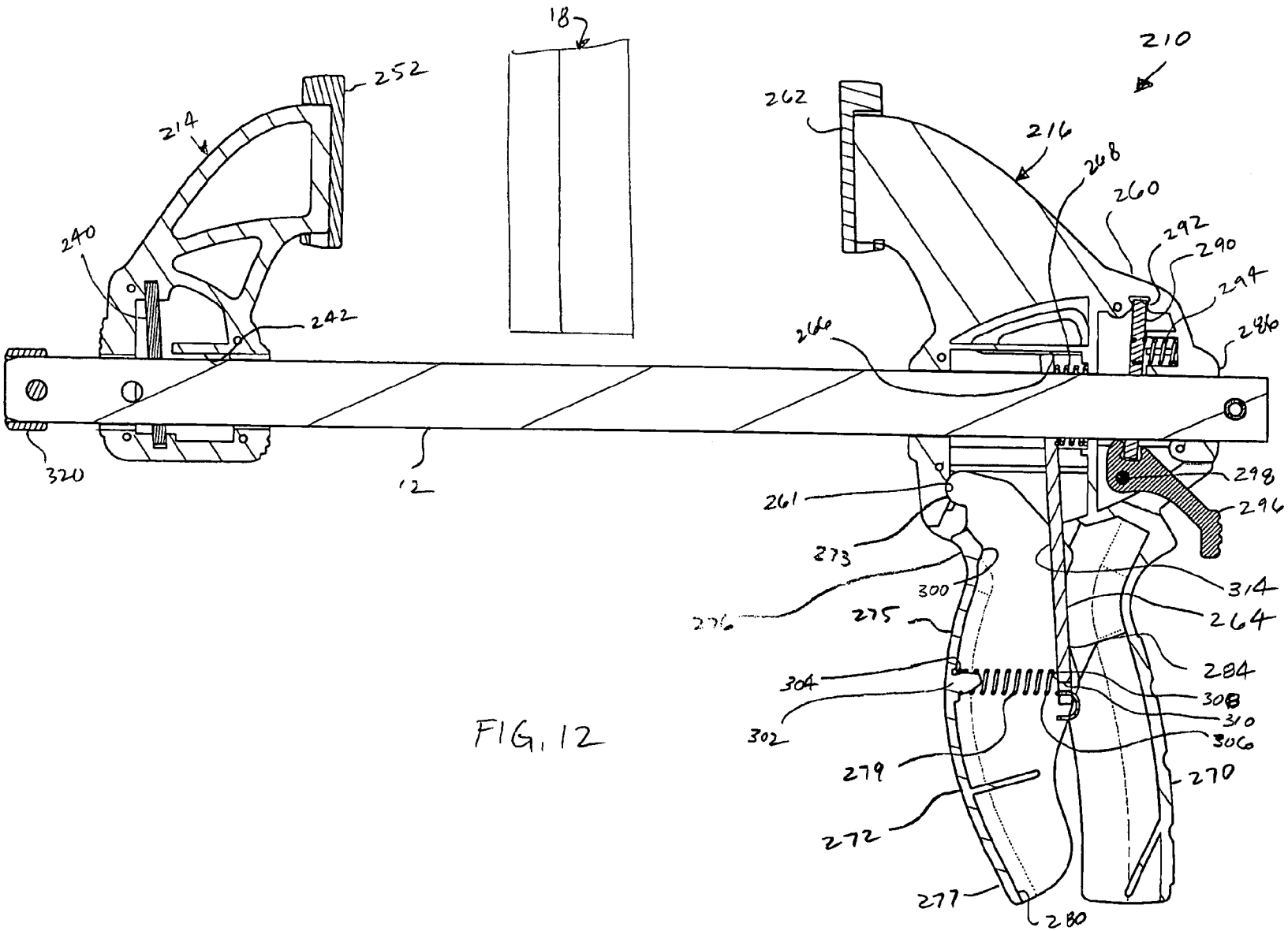
FIG. 12 illustrates the adjustable clamp of FIG. 11 utilizing a low mechanical advantage.
Figure 13:
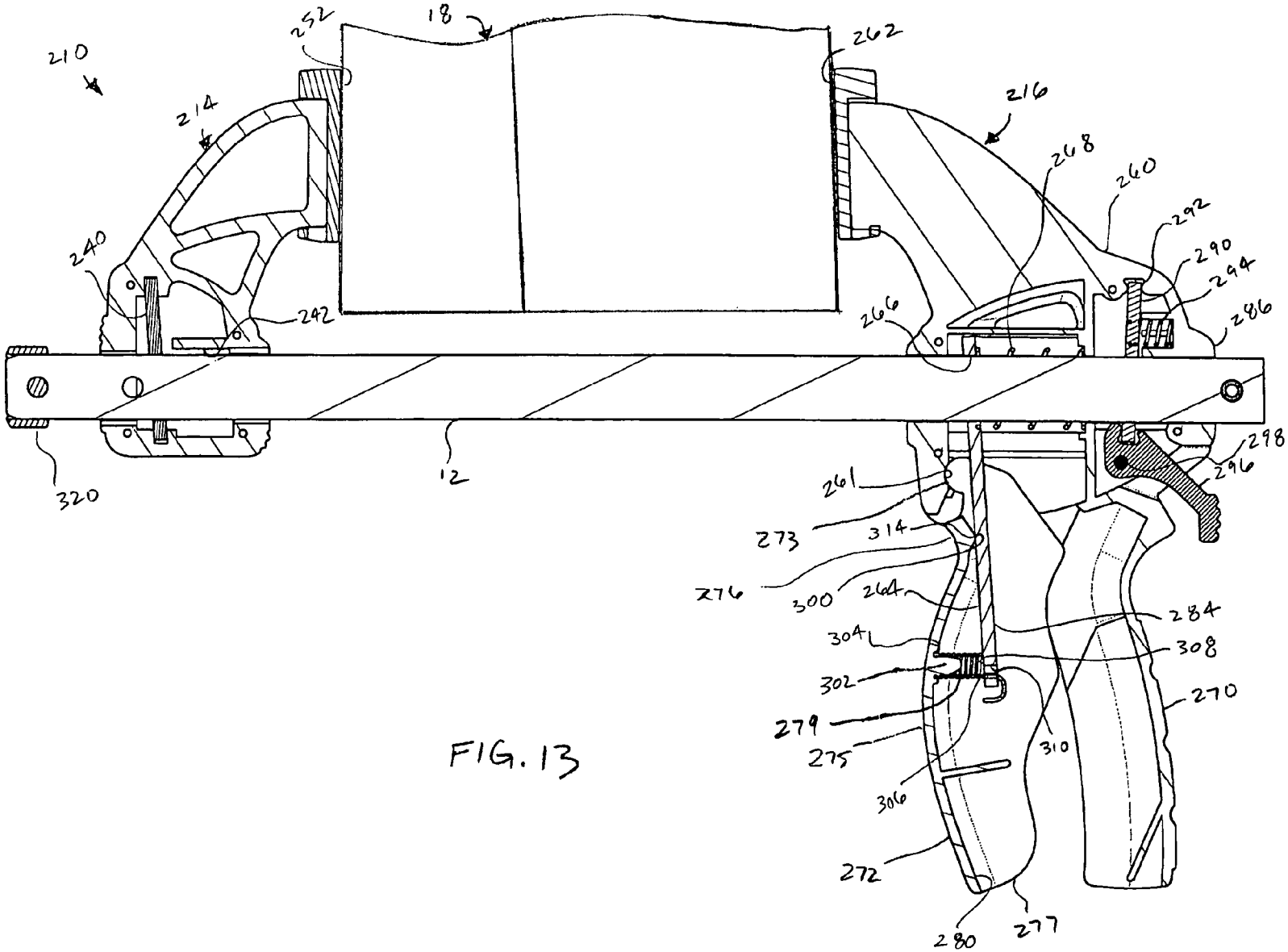
FIG. 13 illustrates the adjustable clamp of FIG. 11 utilizing a high mechanical advantage.
Figure 14:
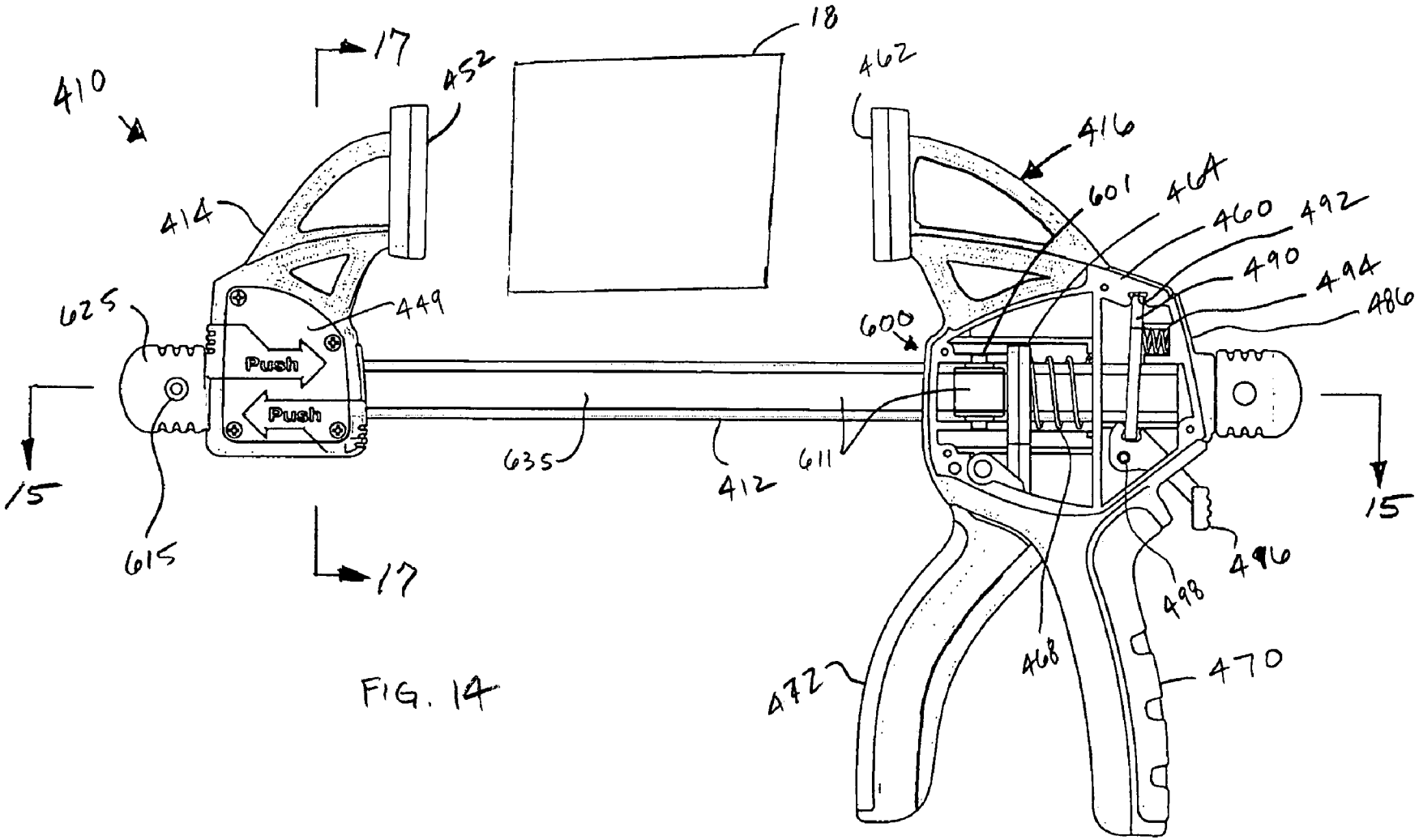
FIG. 14 illustrates a side view of another embodiment of a clamp in accordance with the present invention.

FIGS. 11-13 illustrate an adjustable clamp 210 in accordance with another embodiment of the invention. Clamp 210 has many elements that are substantially identical to clamp 10 described above and those elements are shown in FIGS. 11-13 with the use of reference numbers similar to those identified above with respect to clamp 10.

Clamp 210 includes the bar 12, a moving jaw 214, and a fixed jaw 216. In one embodiment, clamp 210 may be used by positioning jaws 214 and 216 on opposite sides of a member 18 to be clamped. The fixed jaw 216 is then activated to pull the bar 12 through the fixed jaw 216, thus bringing moving jaw 214 closer to fixed jaw 216. The fixed jaw 216 may be automatically activated so that the fixed jaw 216 may move the bar 12 rapidly and easily through the fixed jaw 216 prior to the clamping of the member 18 and then, once the clamping on member 18 begins, the activation of fixed jaw 216 may advance the bar 12 through the fixed jaw 216 at a slower rate but with a higher mechanical advantage so that greater force can be applied in the easiest manner for the user applying the pressure to the fixed jaw 216 by hand.

Although the moving jaw 214 may be any of the various moving-type jaws known in the prior art, moving jaw 214 is illustrated as having a braking lever 240 positioned within the moving jaw housing 242. The moving jaw housing 242 includes an opening 253 for permitting the bar 12 to pass therethrough. Also, the braking lever 240 includes an aperture 256 for permitting the bar 12 to pass therethough. As seen in FIG. 11, the opening 253 permits a first clearance gap 254 between the bar 12 and a first surface 257 of the housing 242, and a second clearance gap 255 between the bar 12 and a second surface 258 of the housing 242. The principle of adjustment of moving jaw 214 is based on the ability of moving jaw 214 to rotate relative to bar 12 in order to move the braking lever 240 between a free position wherein the braking lever 240 is substantially normal to axis 50 of bar 12 to allow movement of moving jaw 214 in both directions along the bar 12, as desired, and a locked position (shown in FIG. 11) wherein the breaking lever 240 is no longer normal to the axis 50 of the bar 12 and engages the bar 12. The opening 253 through jaw housing 242 receiving bar 12 has sufficient clearance with respect to the bar 12, including with first and second clearance gaps 254 and 255, to enable sufficient rotation of moving jaw 214 relative to the bar 12 to both enable release and locking of braking lever 240. Thus, the moving jaw 214 may be moved to a selected position on the bar 12 in either direction along the bar and then be clamped against member 18 upon activation of the fixed jaw 216. When the moving jaw 214 is clamped against a member 18, the clamping force rotates the moving jaw 214 (in a counter-clockwise direction with respect to FIG. 11) to the locked position illustrated in FIG. 11 so that the braking lever 240 engages the bar 12. The moving jaw 214 has a clamping face 252 for engaging member 18. When the moving jaw 214 is clamped against the member 18, the moving jaw 214 is in the locked position with respect to the bar 12. When the clamping force is released, the moving jaw 214 may be pivoted back to the free position (in a clockwise direction with respect to FIG. 11). Of course, the moving jaw 14 described with respect to clamp 10 above, or other appropriate moving jaws, may be employed in clamp 210 in place of or in addition to moving jaw 214. As described herein, the moving jaw 214 and the fixed jaw 216 may also be removed from the bar 12 and used as described above.

Fixed jaw 216, as illustrated in FIGS. 11-13, has a main section that is structured and arranged to permit the bar 12 to pass there-through. As illustrated, the main section comprises a housing 260 having an opening extending completely there-through for the passage of bar 12. The fixed jaw 216 also has a clamping face 262 extending from the housing 260. A drive lever 264 is positioned within the housing 260 and is structured and arranged to couple the bar 12. That is, the illustrated drive lever 264 has an opening 266 extending therethrough for the passage of bar 12. The drive lever 264 is movable within the housing 260 and may be maintained within its area of movement within the housing 260 by the housing 260 itself. Drive lever 264 is biased by a resilient element, such as a spring 268 in a direction away from handle 270, which extends from housing 260 for grasping by a user. In FIGS. 11 and 13, the spring 268 is show as being sufficiently compressed to apply a constant force against the drive lever 264 in a direction away from the rear 286 of the housing 242. Meanwhile in FIG. 12, the spring 268 is substantially compressed by the drive lever 264.

A trigger 272 is pivoted to the main section housing 260. The trigger 272 may pivot, for example, about a rounded lug 273 extending from a main body portion 275 of the trigger. The lug 273 may pivot and be secured within a recess 261 in housing 260 of the main section that has a complementary shape, which substantially mirrors the shape of the lug 273. As illustrated in FIGS. 11-13, trigger 272 is pivoted to the housing 260 toward an upper section 276 of the trigger 272. The lower section 277 of the trigger 272 remains unattached and moves corresponding to the pivoting of the trigger 272.

The trigger 272 may be hollow with three sides while open in the side facing handle 270. The trigger 272 is shown in the nonactuated position in FIG. 11, in which the drive lever 264 is substantially normal to bar 12 to ensure freedom of movement of the drive lever 264 with respect to the bar 12. When the trigger 272 is in the nonactuated position, the trigger 272 is biased to pivot away from the handle 270 by the force of biasing spring 268 against the drive lever 264 and the force of biasing spring 279, which is positioned between the drive lever 264 and the inner contact surface 280 of the trigger 272. Although various apparatus may be employed to provide the connection between the trigger 272 and the drive lever 264, the connection may be made by a resilient member as illustrated and described herein. For example, as illustrated in FIGS. 11-13, the connection includes a projection 302 that extends from the inner contact surface 280 to support one end 304 of compression spring 279. The other end 306 of spring 279 may be securely attached to drive lever 264 at a point 308 on drive lever 264 that is remote from the bar 12. In the illustrated embodiment, the end 306 of spring 279 may be inserted through an opening 310 in drive lever 264 to complete the connection. Thus, in the nonactuated position of FIG. 11, the trigger 272 is biased away from the handle 270 by the force of the compression spring 279, while the drive lever 264 is biased away from the handle 270 by spring 268. Meanwhile, an upper end of the trigger 272 includes an upper force applying member 300 for applying a high mechanical advantage as described below. In FIGS. 11 and 12, the spring 279 is in a substantially neutral, substantially uncompressed state. In FIG. 13, the spring 279 is in a compressed state.

The interconnection between the bar 12 and the drive lever 264 is substantially identical to the relationship between bar 12 and drive lever 64 described above. Since the size of the opening 266 in drive lever 264 is slightly larger than the width of the bar 12, when the angle of drive lever 264 is inclined with respect to a line parallel to the longitudinal axis 50 of the bar 12, a tight, slip-free fit is created between the bar 12 and the drive lever 264 so that when the drive lever 264 is moved, the bar 12 moves along with the drive lever 264.

FIGS. 11-13 illustrate the pivoting of trigger 272 and the changing of the contact point between the trigger 272 and the drive lever 264. In FIG. 11, the trigger 272 is in the nonactuated position as biased by springs 268 and 279. The trigger 272 contacts the driving lever 264 via spring 279 at the initial contact point 308, which is at the remote end 284 of drive lever 264 from the bar 12. Therefore, when the trigger 272 initially is pulled by a hand of the user and pivots about lug 273 toward the handle 270 out of the nonactuated position, the contact point 308 between the trigger 272 and the drive lever 64 is such that a low mechanical advantage is produced for forcing the drive lever 264 to move the bar 12 toward the rear end 286 of housing 260. This movement produces a relatively large displacement of the bar 12 through the housing 260 as a relatively light force is applied by the user on the trigger 272 at the remote point 308. Generally, the use of only the low mechanical advantage will be employed prior to the engagement of clamp 210 with clamped members 18. Thus, at this time, the force necessary to move the bar 12 relative to the housing 260 is generally a force that is able to move merely the bar 12 and the moving jaw 214. Therefore, the spring 279 or other resilient member may be designed so that it will not compress to undesired levels while acting against the force of the bar 12 and moving jaw 214 to move the bar 12 relative to the housing, prior to the jaws 214 and 216 engaging the members 18, as illustrated in FIG. 12. In other words, during low force applications, the spring 279 is designed to provide a sufficient force against the drive lever 264 to move the drive lever 264 while a user pulls on the trigger 272 while keeping the drive lever 264 from engaging the upper force applying mechanism 300 of the trigger 272, which produces a high mechanical advantage with smaller, incremental movements of the bar 12 relative to the housing 260.

When the clamp 210 requires greater force than that for which the spring 279 is designed, the upper force applying mechanism 300 of the trigger 272 provides a high mechanical advantage. The mechanism 300 extends as a projection from the inner contact surface 280 toward the handle and provides a point of contact with drive lever 264 at a point 314 on drive lever 264 that is closer to the bar 12 than the point 308. The projection 300 may directly contact drive lever 264 and provide a greater application of force to the drive lever 264 to move the bar 12 relative to the housing 260 when more force is needed. For example, as illustrated in FIG. 13, when the jaws 214 and 216 are engaged with the members 18 and a tight connection between the members 18 is desired, as greater force is applied by the jaws 214 and 216 and that force overcomes the force applied by spring 279. When this happens, the spring 279 compresses and permits contact between the drive lever 264 and the projection 300 as illustrated in FIG. 13. Then, as the trigger 272 is pulled further toward the handle 260 a higher mechanical advantage and larger force are applied to bar 12 to move the bar 12 relative to housing 260 and to increase the force applied by the jaws 214 and 216. The shape of the trigger 272 may be configured to increase the mechanical advantage applied by the projection 300. For example, as illustrated in FIG. 13, the mechanical advantage of the projection 300 is increased by the downward and curved shaping of the trigger 272 and its primary gripping area.

Therefore, if, for example, the fixed jaw 216 is not in contact with the member 18 a user can quickly and easily pull the trigger 272 to its fullest extent and rapidly repeat the full trigger pulls to quickly and easily move the drive lever 264 and the bar 12 toward the rear 286 of housing 260 since the contact point 308 is being moved by the resilient member, spring 279. Then, when, for example, the jaws 214 and 216 are in contact with the member 18 and it is desired to clamp the member 18 with a larger force requiring little movement of the bar 12, the force required to move the drive lever 264 increases to the extent that as the trigger 272 is moved toward the handle 270, the spring 279 compresses and permits the projection 300 to contact the drive lever 264. Thus, the projection 300 now provides the force necessary to move the drive lever 264 and bar 12 and to increase the force applied by the jaws 214 and 216 on members 18.

Although, the illustrated embodiment only shows two contact points 308 and 314, the contact surface 280 of trigger 272 may be designed so that there is any number of contact points between the trigger 272 and the drive lever 264 to provide various levels of mechanical advantage.

When it is desired to release the clamping force and the bar 12, fixed jaw 216 includes a breaking lever 290 that permits the bar 12 to pass therethrough. The braking lever 290 is pivoted within the housing 260 within a groove 292 and is biased by a resilient element, such as a spring 294. The operation of the braking lever 290 is substantially identical to the operation of braking lever 90 described above.

The clamp 210 includes a removable end stop 320 that may be removed to permit the jaws 214 and 216 to be removed from bar 12 and used in the variety of ways described above with respect to the other embodiments of the invention disclosed therein, including, but not limited to, use as a spreader and the use of two movable jaws 214.

FIGS. 14-20 illustrate an adjustable clamp 410 in accordance with another embodiment of the invention. Clamp 410 has many elements that are substantially identical to clamp 10 described above and those elements are shown in FIGS. 14-20 with the use of reference numbers similar to those identified above with respect to clamp 10.

Clamp 410 includes the bar 412, a moving jaw 414, and a fixed jaw 416. In one embodiment, clamp 410 may be used by positioning jaws 414 and 416 on opposite sides of a member 18 to be clamped. The fixed jaw 416 is then activated to pull the bar 412 through the fixed jaw 416, thus bringing moving jaw 414 closer to fixed jaw 416. Through the use of motor 600, the fixed jaw 416 may be automatically activated so that the fixed jaw 416 may move the bar 412 rapidly and easily through the fixed jaw 416 prior to the clamping of the member 18 and then, once the clamping on member 18 begins, the activation of fixed jaw 416 may advance the bar 412 through the fixed jaw 416 at a slower rate but with a high mechanical advantage so that a tight clamping force can be applied to the member 18 to be clamped.

Figure 15:
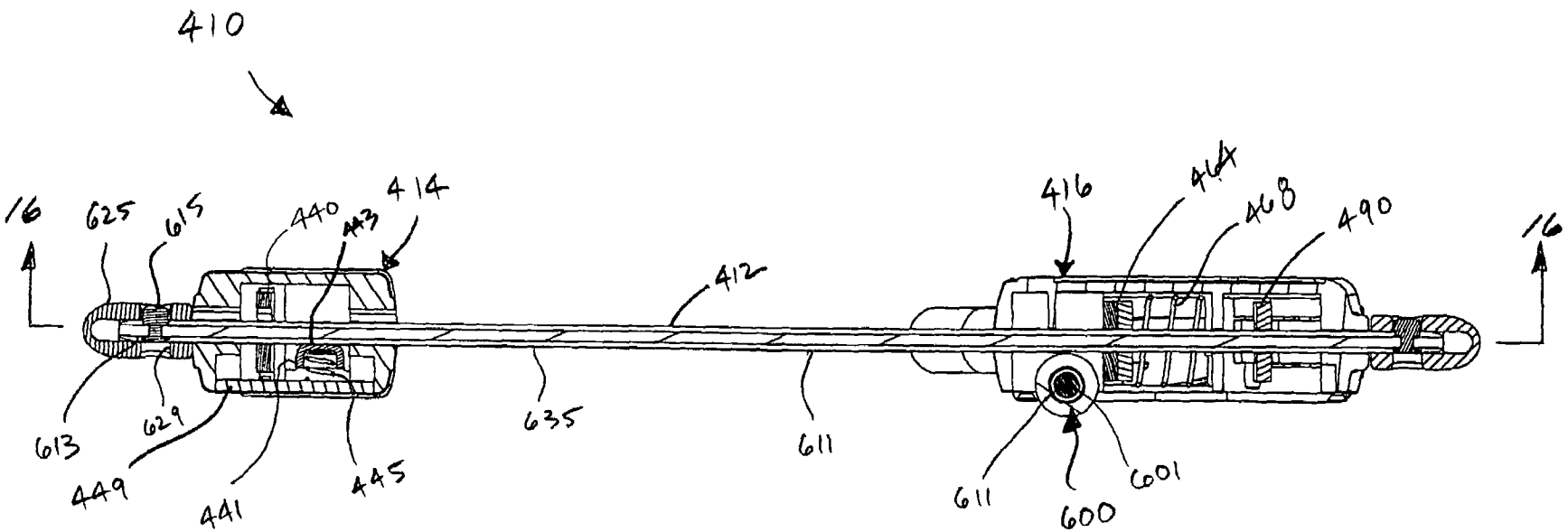
FIG. 15 is a cross-section of the clamp of FIG. 14 taken along line 15-15 in FIG. 14.
Figure 16:
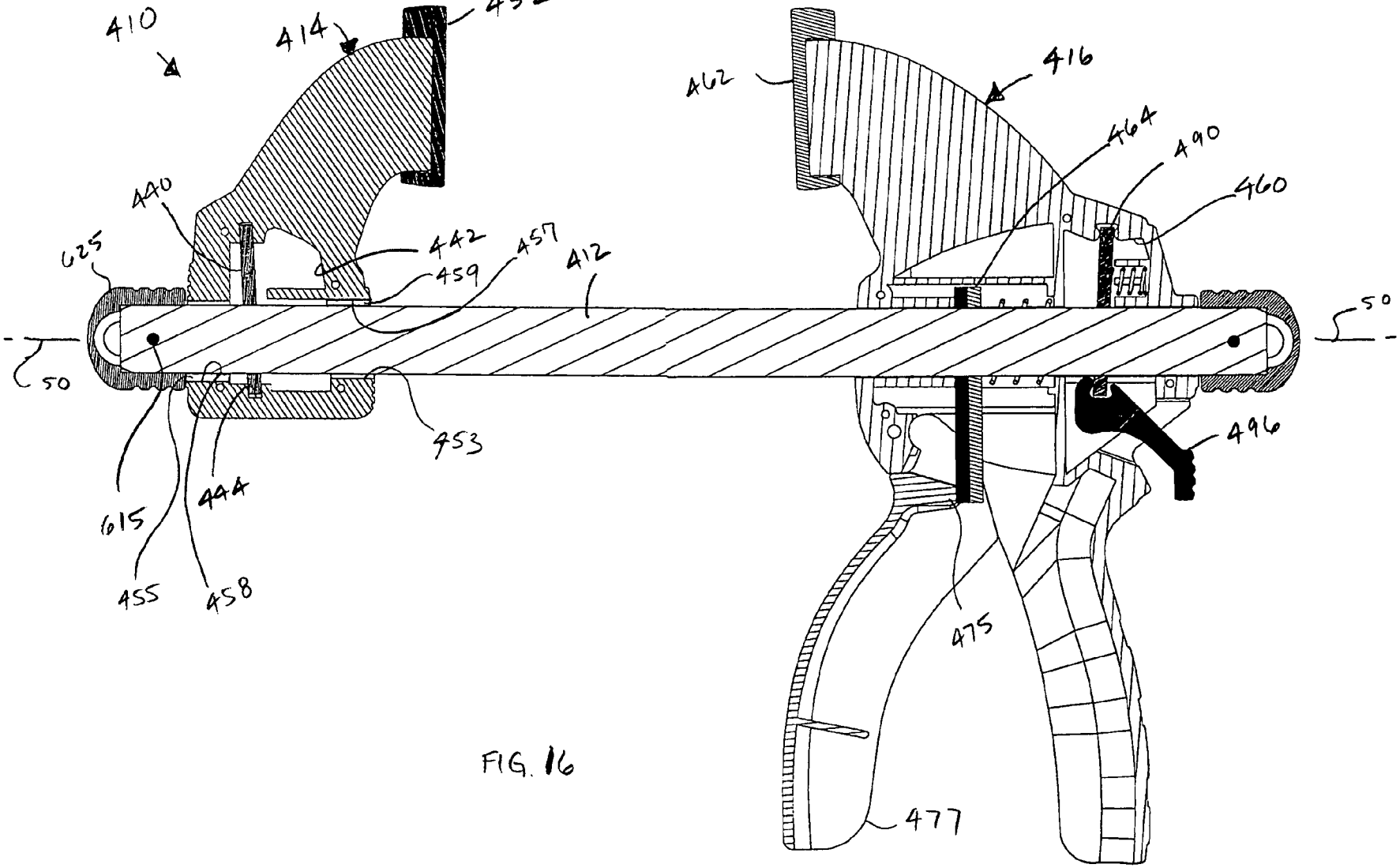
FIG. 16 is a cross-section of the clamp of FIG. 14 taken along line 16-16 in FIG. 15.
Figure 17:
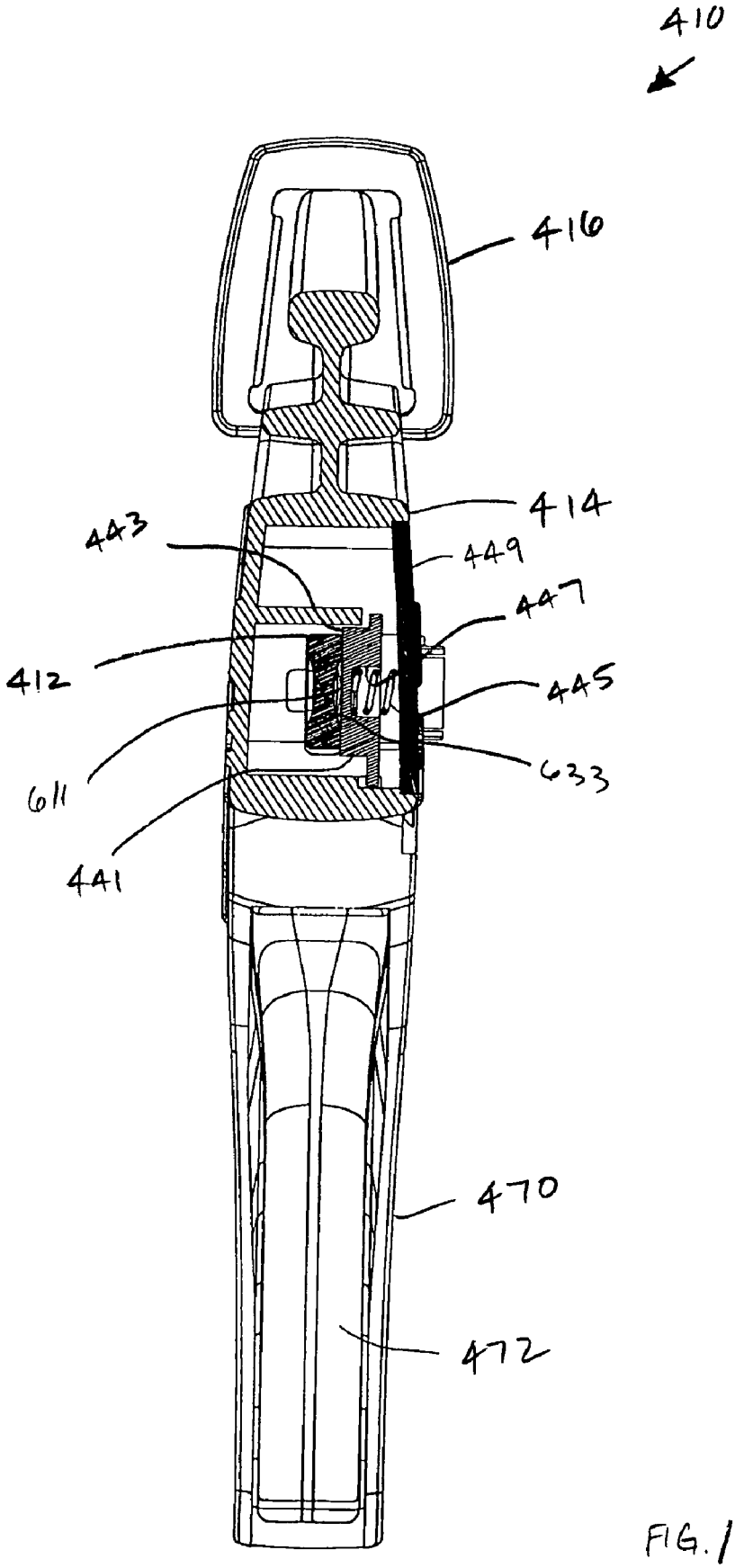
FIG. 17 is a cross-section of the clamp of FIG. 14 taken along line 17-17 in FIG. 14.
Figure 18:
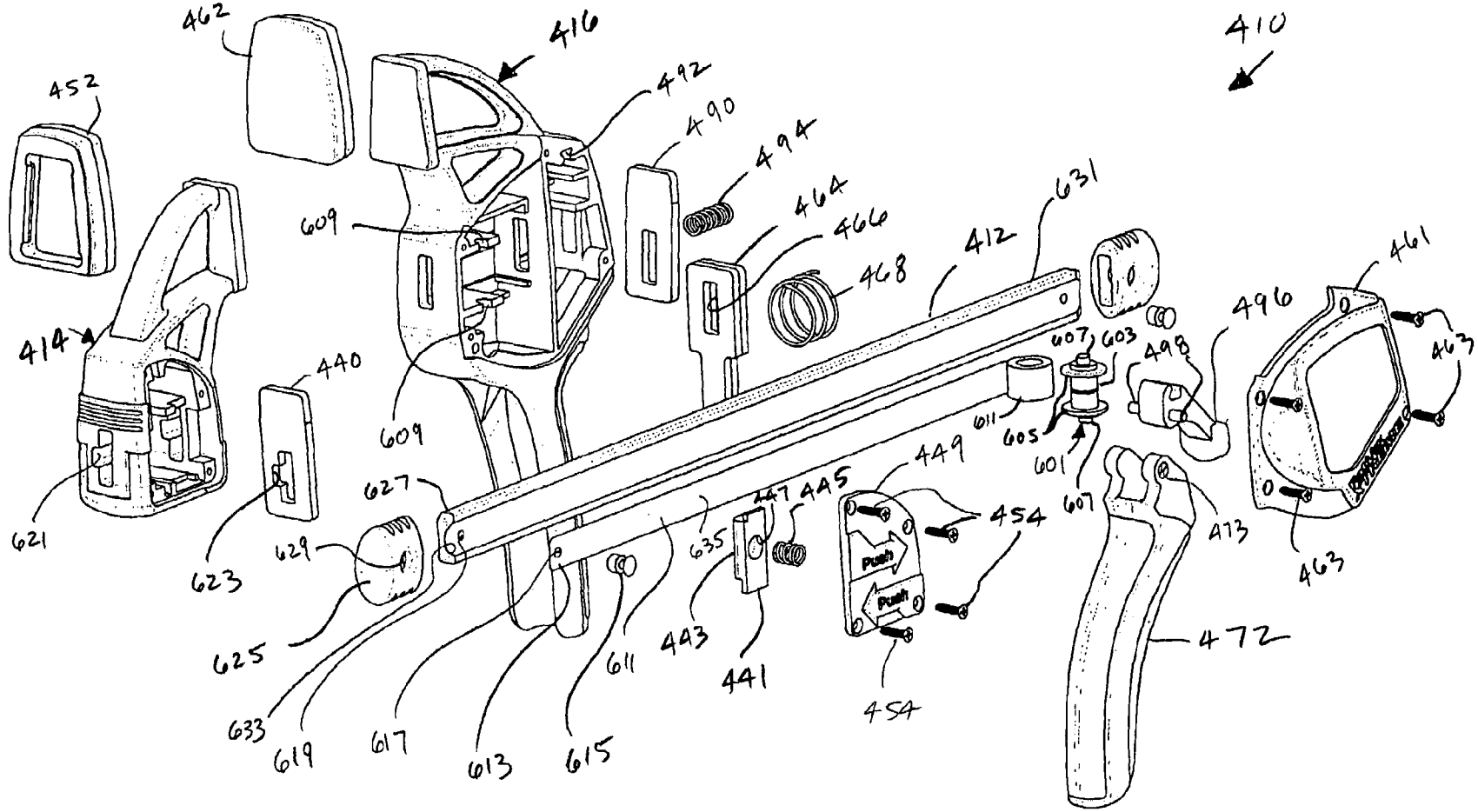
FIG. 18 is an exploded, perspective view of the clamp of FIG. 14.
Figure 19:
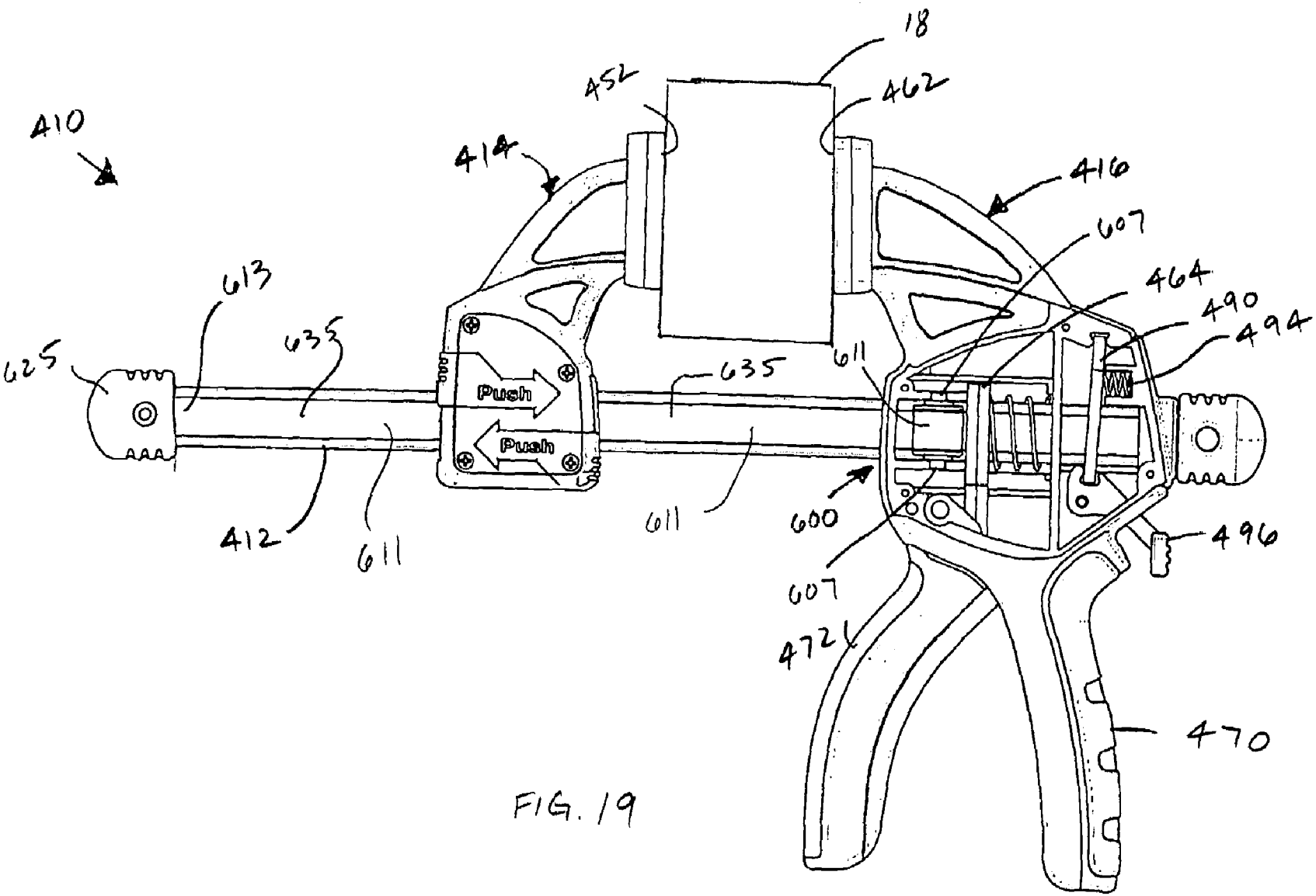
FIG. 19 is a side view of the embodiment of FIG. 14, but showing the moving jaw at a position closer to the fixed jaw.
Figure 20:
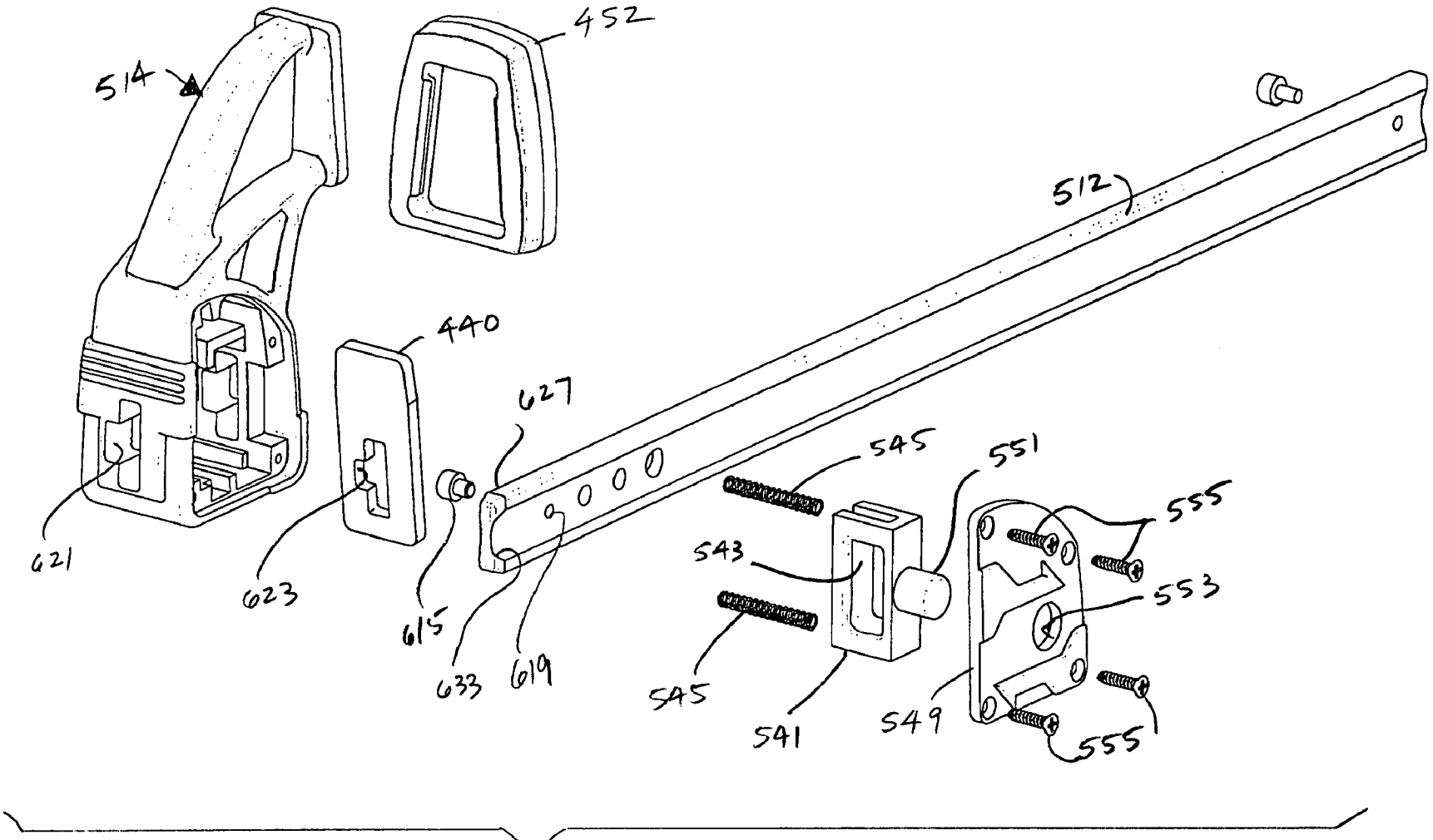
FIG. 20 is a partial, exploded view of another embodiment for a moving jaw of the embodiment of FIG. 14.

Moving jaw 414 may be any of the various moving-type jaws known in the prior art and may be substantially identical to moving jaw 214 described above. The moving jaw housing 442 includes an opening 453 for permitting the bar 412 to pass therethrough. Also, the braking lever 440 includes an aperture 456 for permitting the bar 412 to pass therethough. As seen in FIG. 16, the opening 453 permits a first clearance gap 459 between the bar 412 and a first surface 457 of the housing 442, and a second clearance gap 455 between the bar 412 and a second surface 458 of the housing 442. The principle of adjustment of moving jaw 414 is based on the ability of moving jaw 414 to rotate relative to bar 412 in order to move the braking lever 440 between a free position wherein the braking lever 440 is substantially normal to axis 50 of bar 412 to allow movement of moving jaw 414 in both directions along the bar 412, as desired, and a locked position (shown in FIG. 16) wherein the breaking lever 440 is no longer normal to the axis 50 of the bar 412 and engages the bar 412. The opening 453 through jaw housing 442 receiving bar 412 has sufficient clearance with respect to the bar 412, including with first and second clearance gaps 459 and 455, to enable sufficient rotation of moving jaw 414 relative to the bar 412 to both enable release and locking of braking lever 440. Thus, the moving jaw 414 may be moved to a selected position on the bar 412 in either direction along the bar 412 and then be clamped against member 18 (as seen in FIG. 19) upon activation of the fixed jaw 416. When the moving jaw 414 is clamped against a member 18, the clamping force acts to rotate the moving jaw 414 (in a counter-clockwise direction with respect to FIG. 16) to the locked position illustrated in FIG. 16 so that the braking lever 440 engages the bar 412. The moving jaw 414 has a clamping face 452 for engaging member 18. When the moving jaw 414 is clamped against the member 18, the moving jaw 414 is in the locked position with respect to the bar 412. When the clamping force is released, the moving jaw 414 may be pivoted back to the free position (in a clockwise direction with respect to FIG. 16). Of course, the moving jaw 14 described with respect to clamp 10 above, or other appropriate moving jaws, may be employed in clamp 410 in place of or in addition to moving jaw 414. As described herein, the moving jaw 414 and the fixed jaw 416 may also be removed from the bar 412 and used as described above. In use, the moving jaw 414 may be movable by hand by the user in two directions with respect to bar 412, both toward and away from the fixed jaw 416 (as indicated by the "Push" instructions on the cover 449 of the moving jaw 414). To provide some frictional engagement between the bar 412 and the moving jaw 414, the moving jaw 414 may include a pressure device 441, which may be positioned within the housing 442 and include a surface 443, which applies a slight pressure on the bar 412 due to the resilient force applying member 445, which is illustrated as a spring. The spring 445 sits in a recess 447 in the device 441 and applies a force on the device 441 since the spring 445 is compressed by the housing cover 445, which may be attached to the housing 442 in any appropriate manner, such as by fasteners 454. In FIGS. 15 and 17, the spring 445 is illustrated as being sufficiently compressed to apply a desired force against the pressure device 441 and against the bar 412. FIG. 20 illustrates one alternative embodiment to the device 441.

FIG. 20 illustrates a pressure device 541, which is normally biased against a bar 512 (but in the opposite direction than that in the device 441) by a resilient force applying member, such as springs 545. The device 541 includes a button 551, which passes through an opening 553 in housing cover 549, which is secured to the housing 542 by, for example, fasteners 555. Thus, the spring-loaded device 541 applies friction to the bar 412 and maintains the moving jaw 514 in a secured position on the bar 412. Once the button 551 is depressed to counteract the springs 545 and release the device 541 from the bar 412, the moving jaw 514 is freely and easily movable along the bar 412. Of course, the devices 441 and 541 can take various forms and apply various levels of force against the bar. For example, the devices 441 and 541 may apply a force that still permits a user to move the moving jaws 414 and 514 by hand or may apply a force that prohibits a user from moving the jaws 414 and 514 by hand.

Thus, the moving jaw 414 may be moved to a selected position on the bar 412 and then be clamped against member 18 upon activation of the fixed jaw 416. The moving jaw 414 has clamping face 452 for engaging member 18. Of course, the moving jaw 14 described with respect to clamp 10 above, or other appropriate moving jaws, may be employed in clamp 410 in place of or in addition to moving jaw 414. As described herein, the moving jaw 414 and the fixed jaws may also be removed from the bar 412 and used as described above in various configurations and with various bars.

Fixed jaw 416, as illustrated in FIGS. 14-19, has a main section that is structured and arranged to permit the bar 412 to pass therethrough. As illustrated, the main section comprises a housing 460 having an opening extending completely therethrough for the passage of bar 412. The fixed jaw 416 also has a clamping face 462 extending from the housing 460. A drive lever 464 is positioned within the housing 460 and is structured and arranged to couple the bar 412. In the illustrated embodiment, drive lever 464 is formed of two levers that work together to provide the necessary clamping and release functions, as generally known in the art. For the purposes of this description, both drive levers will be discussed as forming the drive lever 464. The illustrated drive lever 464 has an opening 466 extending therethrough for the passage of bar 412. The drive lever 464 is movable within the housing 460 and may be maintained within its area of movement within the housing 460 by the housing 460 itself. Drive lever 464 is biased by a resilient element, such as a spring 468 in a direction away from handle 470, which extends from housing 460 for grasping by a user. In FIGS. 14-16, and 19, the spring 468 is shown as being sufficiently compressed to provide a force against the drive lever 464 away from the rear 486 of the housing 460. (Of course, in the exploded views of FIGS. 18 and 20, all of the illustrated springs are shown in their neutral, relaxed state.)

A trigger 472 is pivoted to the main section housing 460 in any appropriate manner. For example, the trigger 472 may pivot about pivot pins or lugs that are formed on the housing 460 and which are positioned within holes 473 in the upper portion of the trigger 472. The lower section 477 of the trigger 472 remains unattached and moves corresponding to the pivoting of the trigger 472.

The trigger 472 may be hollow with three sides while open in the side facing handle 470. The trigger 472 is shown in the nonactuated position in FIG. 14. When the trigger 472 is in the nonactuated position, the trigger 472 is biased to pivot away from the handle 470 by the force of biasing spring 468 against the drive lever 464. Although various apparatus may be employed to provide the connection between the trigger 472 and the drive lever 464, such as those described herein, the connection is illustrated as employing a fulcrum 475. For example, as illustrated in FIG. 16, the connection includes the fulcrum 475 contacting against a lower portion of the drive lever 464.

The interconnection between the bar 412 and the drive lever 464 is substantially identical to the relationship between bar 12 and drive lever 64 described above. Since the size of the opening 466 in drive lever 464 is slightly larger than the width of the bar 412, when the angle of bar 412 is inclined with respect to a line parallel to the longitudinal axis 50 of the bar 412, a tight, slip-free fit is created between the bar 412 and the drive lever 464 so that when the drive lever 464 is moved by the movement of the trigger 472 and the pressing of the fulcrum 475 against the lower end of the drive lever 464, the bar 412 moves along with the drive lever 464. A breaking lever 490 then maintains the bar 412 in its new position relative to the fixed jaw 416 as further described below. Repeating the pressing of the trigger 472 and, thereby, forcing the fulcrum 475 against the drive lever 464, repeatedly moves the bar 412 through the fixed jaw 416 and brings the movable jaw 414 closer to the fixed jaw 416.

To release the clamping force on the bar 412, fixed jaw 416 includes the breaking lever 490, which, upon being appropriately moved, permits the bar 412 to pass freely therethrough. The braking lever 490 is pivoted within the housing 460 within a groove 492 and is biased by a resilient element, such as a spring 494. The operation of the braking lever 490 is substantially identical to the operation of braking lever 90 described above. Basically, the breaking lever 490 prohibits movement of the bar 412 through the housing in the direction toward the moving jaw 414 unless the release 496 is activated to move the breaking lever 490 to its free position with respect to the bar 412.

The fixed jaw 416 further includes the motor 600, which provides for the automatic and relatively quick movement of the bar 412 through the fixed jaw 416 and for the movement of the moving bar 414 toward the fixed jaw 416 to close onto the member 18 to be clamped. Motor 600 can take a variety of forms, but is illustrated as including a freely-rotatable spool 601, which has a cylindrical main body 603, two circular end flanges 605, and two pivot pins 607. The pins 607 are pivotally secured within the fixed jaw housing 460 and positioned within respective recesses 609, which secure the spool 601, but permit the spool 601 to rotate about an axis extending through the pins 607. A motor element in the form of a constant-force coil spring 611 that has one end connected to and wound around the main body 603 of the spool 601 while the other, extended end 613 is rigidly secured to the bar 412 via any appropriate device, such as a fastener 615. Fastener 615 is shown as extending though openings 617 and 619 in the spring 601 and the bar 412, respectively. (As illustrated, the housing 442 of the moving jaw 414 and the breaking lever 440 may include recesses 621 and 623, respectively, to permit the passage through of the fastener 615 so that the moving jaw 414 may be completely removed from the bar 412.) In the figures, spring 611 is shown as being constantly biased to form a wound configuration. When additional portions of the spring 611 are moved toward the fixed jaw 416, as when clamping occurs as seen in FIG. 19, the portions of the spring 611 automatically wind around the other portions of the spring 611 and the spool 601. The spring 611 may take various forms and configurations and be formed of various materials, for example, stainless steel. Additionally, although the end 613 of the spring 611 is illustrated as being attached to the bar 412 to permit the easy removal of the moving jaw 414, spring 611 may be rigidly attached to the moving jaw 414 in addition to or instead of being attached to the bar 412. The housing 460 may enclose the spool 601, including having a housing cover 461 secured to the housing 460 by, for example, fasteners such as screws 463. The covers 449 and 461 may be made of transparent material so that the inner workings of the jaws may be viewed by a user.

The fastener 615 also provides an abutting surface for a stopper 625, which may be positioned on the end 627 of the bar 412. The illustrated stopper 625 is formed of a resilient material, such as rubber, so that it can be fitted over the end 627 of the bar 412 and over the fastener 615. The stopper 625 includes an aperture 629 in which the fastener 615 fits. Then, if the moving jaw 414 is moved toward the end 627 of the bar 412, although the moving jaw 414 has a recess 621 for the fastener 615, the side of the moving jaw 414 will abut the stopper 625 and the moving jaw 414 will remain positioned on the bar 412. Upon removing the stopper 625 from the bar 412, the moving jaw 414 may be removed from the bar 412 as well and used in the variety of ways as described herein. A stopper 625 may also be applied to the opposite end 631 of the bar 412.

The bar 412 may include a recess 633 extending along the entire length of the bar 412 for receiving the extended portion 635 of the spring 611. Thus, the combination of the bar 412 and the spring 611 may be formed to take up no more space than previously taken up by a single bar with a rectangular cross-section. Additionally, the recess 633 permits the spring 611 to extend any length of the bar 412 without interfering with the user of the clamp 410 or with the member 18 to be clamped.

The spring 611 is preferably formed so that it is normally contracting into a coil or forcing itself around the spool 601 and, thus, normally forcing the end 627 of the bar toward the fixed jaw 416. Due to the locking of the breaking lever 490, the fixed jaw 416 remains stationary with respect to the bar 412 even though spring 611 is applying such a force against the bar 412. However, if the release 496 is moved to free the breaking lever 490 from the bar 412, the force of the spring 611 automatically moves the bar 412 through the fixed jaw 416 as the end 613 of the spring 611 moves toward the spool 601. The moving jaw 414 may continue to move quickly in this manner until the moving jaw 414 contacts the fixed jaw 416, the moving jaw 414 contacts the member 18 to be clamped, or the release 496 is released and the breaking lever 490 locks further movement of the bar 412. If the release 496 is permitted to return to its normal position, the breaking lever 490 will return to its normal position and the movement of the bar 412 though the fixed jaw 416 will be stopped. Thus, by holding the handle 470 of the fixed jaw 416 and toggling the release 696, a user can quickly and automatically move the moving jaw 414 toward the fixed jaw 416, and the movement can continue until the jaws 414 and 416 contact the member 18 to be clamped, until the jaws 414 and 416 contact each other, or until the release 496 is toggled or released and permitted to return to its original lock position. Accordingly, the motor 600 provides a very efficient, quick, and automatic way to move the jaws 414 and 416 into contact with the member 18 to be clamped. Then, the clamping force on the member 18 may be increased by pulling the trigger 472 to further move the jaws 414 and 416 together, but with a mechanical advantage. The clamp 410 enables the user to only need to pull the trigger 472 a limited number of times or even just once to clamp the member 18 with a sufficient force. Upon moving the release 496, most or all of the clamping force on the member 18 may be automatically released. Then, a user may additionally grasp the moving jaw 414 and pull the moving jaw 414, along with bar 412, away from the fixed jaw 416. If the release 696 is then permitted to return to its original position, the moving jaw 414 and the bar 412 will be automatically locked relative to the fixed jaw 416 once again.

Of course, the motor 600 may take various forms and configurations. For example, instead of using a spring 611 the motor may use a nonresilient, flexible material that can be wound on the spool 601. The spool 601 may form part of a powered motor, such as an electric motor, to wind the material to create the force to moves the bar 412 through the fixed jaw 416. Other options include using a rotating ratchet wheel having teeth that grip the bar 412. Movement of such a ratchet wheel can provide the movement of the bar 412 through the fixed jaw 416. Such a ratchet wheel could be powered in a variety of ways, including by an electrical motor.

The foregoing embodiments have been provided to illustrate the structural and functional principles of the present invention, and are not intended to be limiting. To the contrary, the present invention is intended to encompass all modifications, alterations, and substitutions within the scope of the appended claims.

What is claimed is:

1. A bar clamp, comprising:

a bar having a longitudinally extending recess therein;

a first jaw movably coupled to said bar;

a second jaw coupled to said bar for adjustable sliding movement relative to the bar between a plurality of locking positions relative to the bar; and a motor configured to move said second jaw toward said first jaw while said second jaw is in one of said locking positions, a portion of said motor positioned within and extending within said recess from the first jaw to the second jaw, said first jaw including a drive lever that engages said bar and a trigger to move said drive lever and move said bar relative to said first jaw, wherein the drive lever and trigger are positioned and arranged to mechanically convert a force applied to the trigger into a clamping force that tends to move the bar and second jaw toward the first jaw.

2. A clamp according to claim 1, wherein said motor includes a spring.

3. A clamp according to claim 2, wherein said spring is a wound spring positioned on a rotatable spool.

4. A clamp according to claim 3, wherein said motor is attached to said first jaw.

5. A clamp according to claim 2, wherein said spring is formed of stainless steel.

6. A clamp according to claim 2, wherein said spring is affixed to said second jaw.

7. A clamp according to claim 1, wherein said motor includes a first element rigidly secured to said bar and rotatably secured to said first jaw.

8. A clamp according to claim 7, wherein said first element contacts said bar, and is positioned within said recess.

9. A clamp according to claim 8, wherein said first element is a spring.

10. A clamp according to claim 1, wherein said first jaw includes a resiliently biased bar breaking lever coupled to a release lever.

11. The clamp of claim 1, further comprising:

a brake lever engageable with said bar to prevent said motor from effecting relative movement that draws said first and second jaws together; and a release member that releases said brake lever from engagement with said bar to enable said motor to effect relative movement that draws said first and second jaws together.

12. A clamp according to claim 11, wherein said brake lever is positioned within said first jaw, and said bar passes through said brake lever.

13. A clamp according to claim 1, wherein said motor is constant-force coil spring.

14. The bar clamp of claim 1, wherein the drive lever is movable with the bar relative to a remainder of the first jaw.

15. The clamp of claim 1, wherein:

the drive lever is pivotally movable relative to the bar between an engaged position in which the drive lever is movable with the bar relative to the first jaw, and a disengaged position in which the drive lever is movable with the first jaw relative to the bar, and the trigger has released and actuated positions, the trigger being positioned and shaped to move the drive lever into its engaged position when the trigger is moved into its actuated position.

16. A method of using a bar clamp, comprising:

sliding a first jaw relative to a bar to which the first jaw and a second jaw are slidably mounted so as to position the first jaw and second jaw on opposite sides of an item to be clamped;

sliding the second jaw between a plurality of longitudinal locking positions along the bar, and locking the second jaw to the bar in a selected one of the plurality of longitudinal locking positions;

while retaining the second jaw in the selected one of the plurality of longitudinal locking positions, activating a rotating element of a motor to provide a clamping force that moves the second jaw closer to the first jaw until the first and second jaws contact opposite sides of the item to be clamped, a portion of the motor extending within a recess in the bar from the first jaw to the second jaw; and activating a trigger to provide an increased clamping force of the first and second jaws against the sides of the item to be clamped, wherein the increased clamping force provided by the trigger is larger than the clamping force provided by the motor.

17. A method according to claim 16, wherein the activating of the rotating element includes moving a release mechanism to permit free movement between the first jaw and the bar.

18. A method according to claim 16, wherein the activating of the rotating element includes permitting a spring to wind around the rotating element.

19. The method of claim 16, wherein the activating the trigger comprises transferring a force from the trigger through a drive lever to the bar to move the bar relative to one of the first and second jaws.

20. The method of claim 16, wherein activating the trigger comprises manually moving the trigger, and wherein the manual movement of the trigger is mechanically converted into the increased clamping force.

21. The method of claim 16, wherein activating the trigger comprises manually moving the trigger, and wherein the manual movement of the trigger is mechanically converted into movement of the first and second jaws closer together.

22. A bar clamp, comprising:

a bar having a longitudinally extending recess;

a first jaw movably coupled to said bar for sliding movement relative to the bar and second jaw;

a second jaw coupled to said bar for adjustable sliding movement relative to the bar between a plurality of locking positions relative to the bar;

a spring urging said first and second jaws toward each other, said spring being positioned within and extending within the recess from the first jaw to the second jaw, said spring being positioned and configured to urge said first and second jaws toward each other while the second jaw is in one of its locking positions; and a manual clamping mechanism comprising a manually actuable trigger, and a drive lever that engages the bar, the drive lever and trigger being positioned and arranged to mechanically convert a manual force applied to the trigger into a clamping force that tends to move the bar and second jaw toward the first jaw.

23. The bar clamp of claim 22, further comprising a manually releasable brake, the brake having released and locking positions, wherein the brake tends to discourage the biasing force of the spring from moving the jaws toward each other when in the locking position, the brake permitting the spring to move the jaws toward each other when in the released position.

24. The bar clamp of claim 23, wherein the manual clamping mechanism is constructed and arranged to be usable to move the jaws toward each other even when the brake is in its locking position.

25. The bar clamp of claim 22, wherein the spring extends between and is attached to the first and second jaws.

26. The bar clamp of claim 25, wherein the spring extends between and is attached to the first jaw and the bar.

27. The bar clamp of claim 22, wherein the spring extends between and is attached to the first jaw and the bar.

28. A method of using a bar clamp, comprising:

sliding a first jaw relative to a bar to which the first jaw and a second jaw are slidably mounted so as to position the first jaw and second jaw on opposite sides of an item to be clamped;

sliding the second jaw between a plurality of longitudinal locking positions along the bar, and locking the second jaw to the bar in a selected one of the plurality of longitudinal locking positions;

permitting a spring force of a spring to move the second jaw closer to the first jaw until the first and second jaws contact opposite sides of the item to be clamped, a portion of the spring extending within a recess in the bar from the first jaw to the second jaw; and while retaining the second jaw in the selected one of the plurality of longitudinal locking positions, activating a trigger to provide an increased clamping force of the first and second jaws against the sides of the item to be clamped.

29. The method of claim 28, wherein the spring extends between and is attached to the first and second jaws.

30. The method of claim 28, wherein permitting the spring force to move the second jaw closer to the first jaw comprises releasing a brake operatively connected with the first jaw so as to enable the spring force to draw the first and second jaws together.

31. The method of claim 28, wherein the increased clamping force provided by the trigger is larger than the spring force provided by the spring.

32. The method of claim 28, wherein activating the trigger comprises manually moving the trigger, and wherein the manual movement of the trigger is mechanically converted into movement of the first and second jaws closer together;

* * * * *